US006743128B2

(12) United States Patent
Liechty, II

(10) Patent No.: US 6,743,128 B2
(45) Date of Patent: Jun. 1, 2004

(54) CUTTING BLADE

(76) Inventor: Victor Jay Liechty, II, 1250 N. 1750 West, Provo, UT (US) 84604

( * ) Notice: Subject to any disclaimer, the term of this patent is extended or adjusted under 35 U.S.C. 154(b) by 0 days.

(21) Appl. No.: 09/835,772

(22) Filed: Apr. 16, 2001

(65) Prior Publication Data

US 2002/0151393 A1 Oct. 17, 2002

(51) Int. Cl.[7] ..... F42B 6/08
(52) U.S. Cl. ..... 473/583; 30/357
(58) Field of Search ..... 30/346, 346.5, 30/346.55, 357; 473/583, 584

(56) References Cited

U.S. PATENT DOCUMENTS 2,691,527 A * 10/1954 Ramsey
2,829,894 A * 4/1958 Henkel
2,909,372 A * 10/1959 Neri
3,514,856 A * 6/1970 Camp et al.
3,761,374 A * 9/1973 Bromer et al.
4,234,191 A * 11/1980 Erlandson
4,916,817 A * 4/1990 Atwater
5,390,936 A * 2/1995 Westenburg
5,458,341 A * 10/1995 Forrest et al.
5,564,713 A * 10/1996 Mizek et al.
5,795,648 A * 8/1998 Goel et al.

* cited by examiner

*Primary Examiner*—John A. Ricci

(57) ABSTRACT

Arrowhead cutting blades having a sharper cutting edge, wherein the angle between opposing grind bevels on either side of a corresponding cutting edge is narrower than that which an arrowhead cutting blade of the same thickness would of normally had. Such an arrowhead blade cutting edge is ground on a necked down thinner edge portion of the precursor blade article (blade form or blade shape) during a strip grinding process (but not limited thereto), wherein the blade has a pair of opposing side faces, an inside corner and a step disposed between each side face and the cutting edge, so as to define the narrower cutting edge angle thereof.

39 Claims, 13 Drawing Sheets

FIG. 1
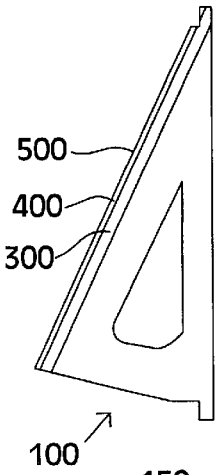
FIG. 2
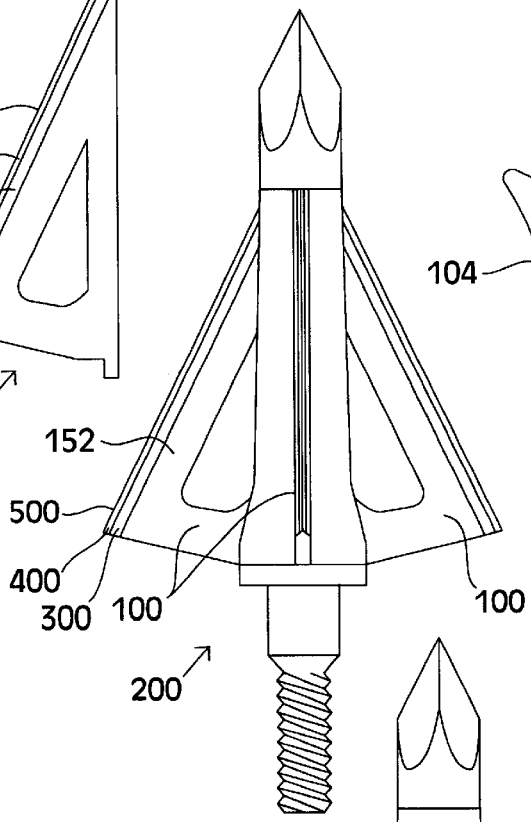
FIG. 3
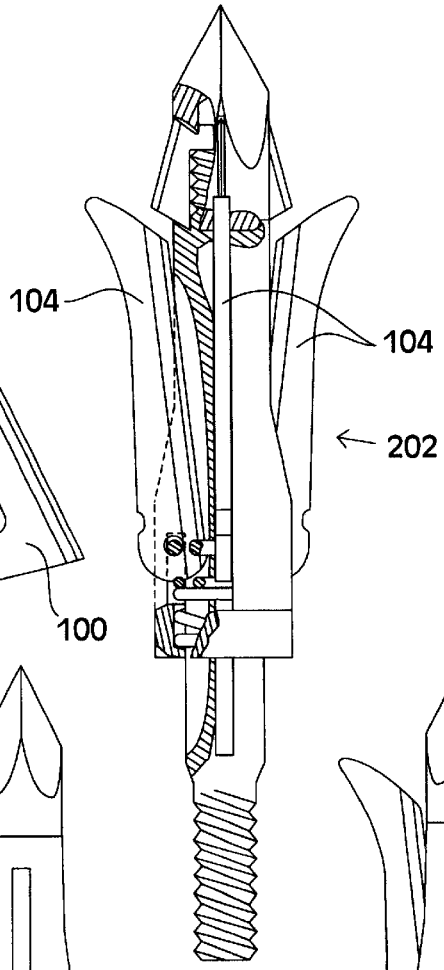
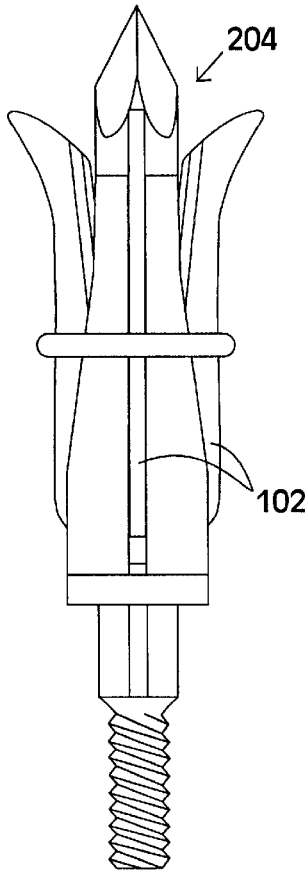
FIG. 4
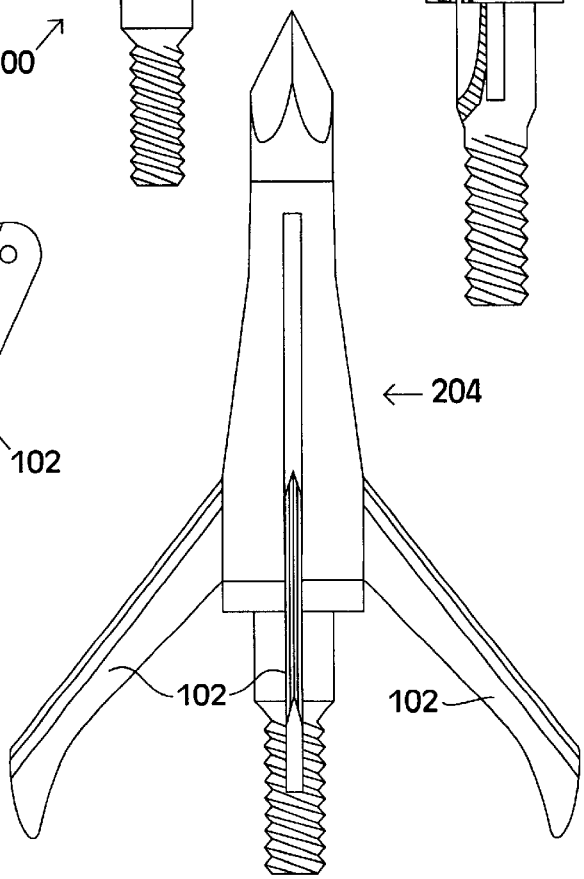
FIG. 5
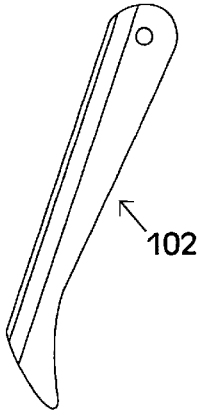
FIG. 6

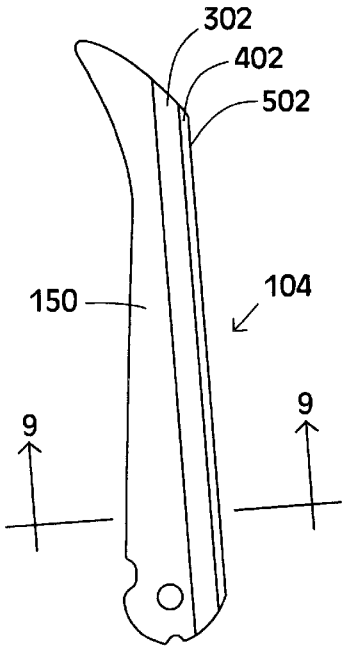
FIG. 7
FIG. 11
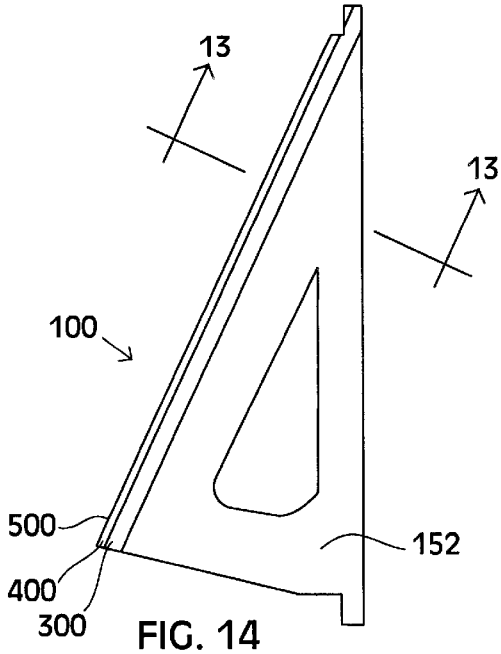
FIG. 14
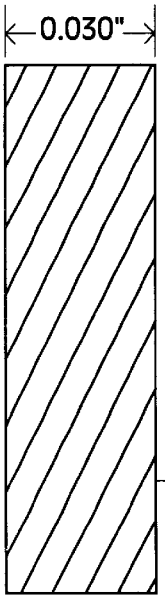
FIG. 8
FIG. 10
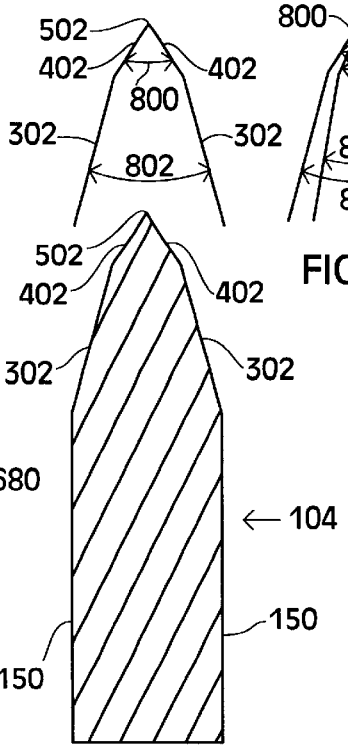
FIG. 9
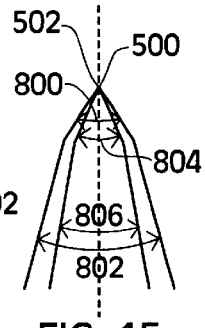
FIG. 15
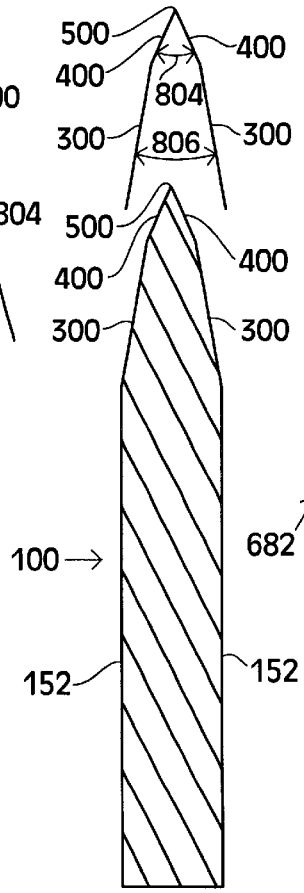
FIG. 13
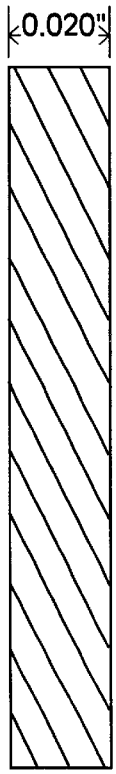
FIG. 12

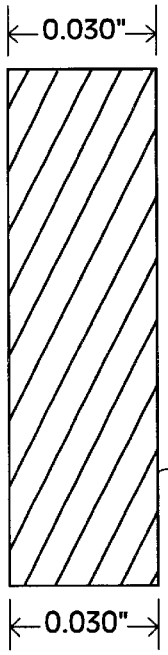
FIG. 17
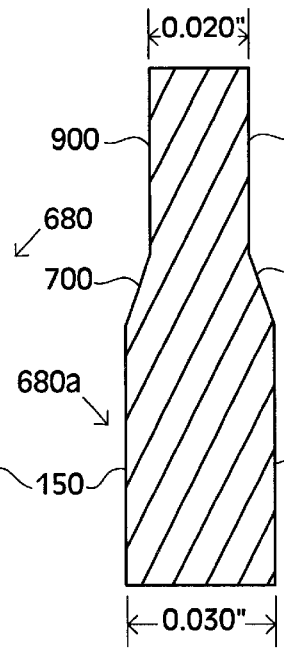
FIG. 18
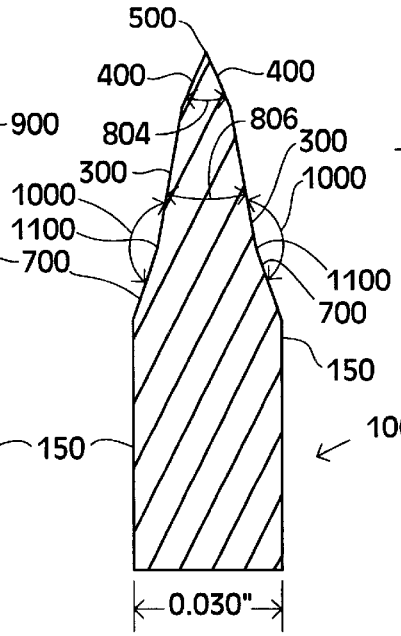
FIG. 19
FIG. 16
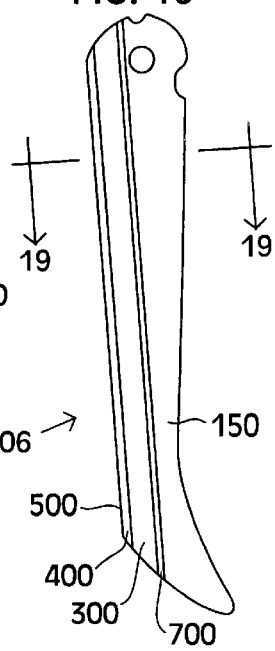
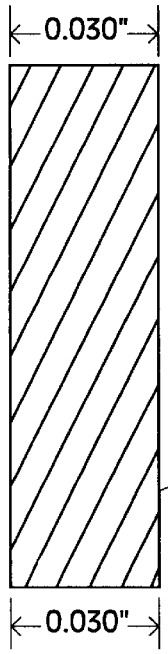
FIG. 20
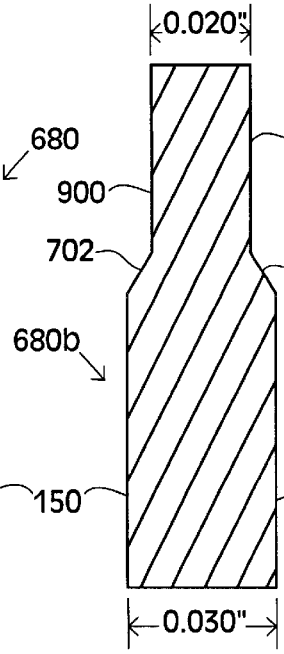
FIG. 21
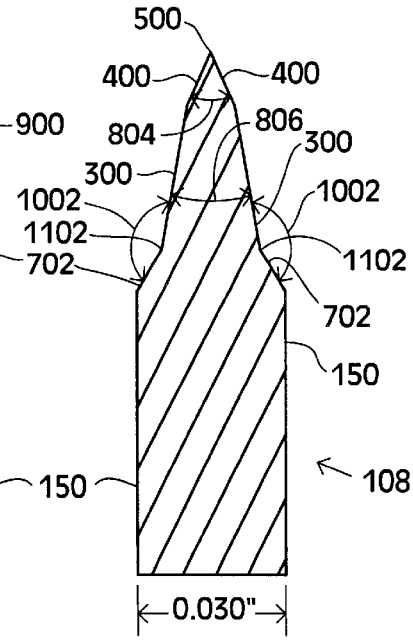
FIG. 22

106

138
120

116

118

122
506
704

126

124

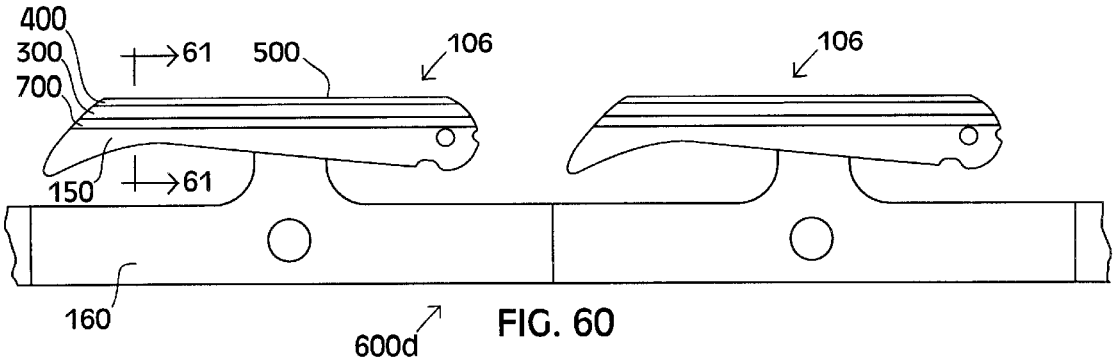
FIG. 60
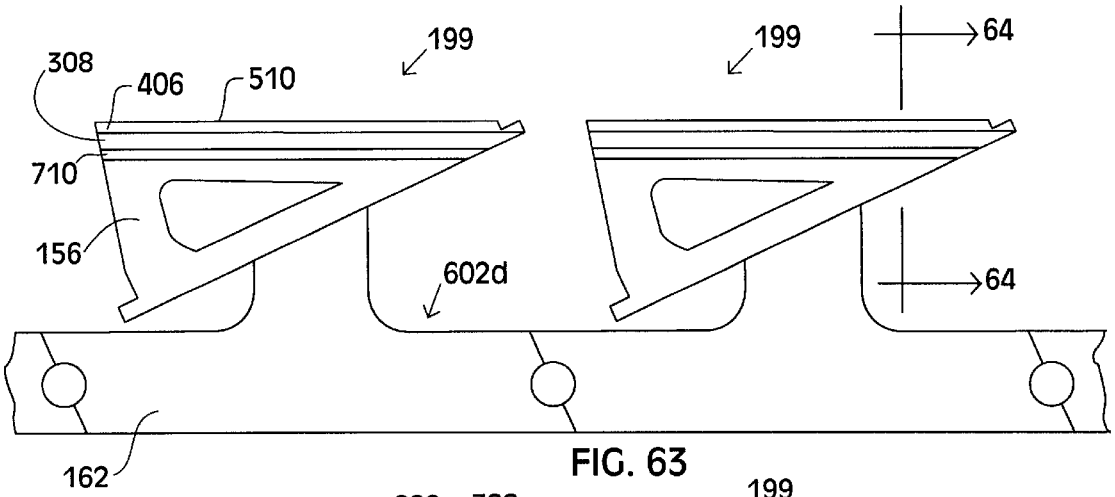
FIG. 63
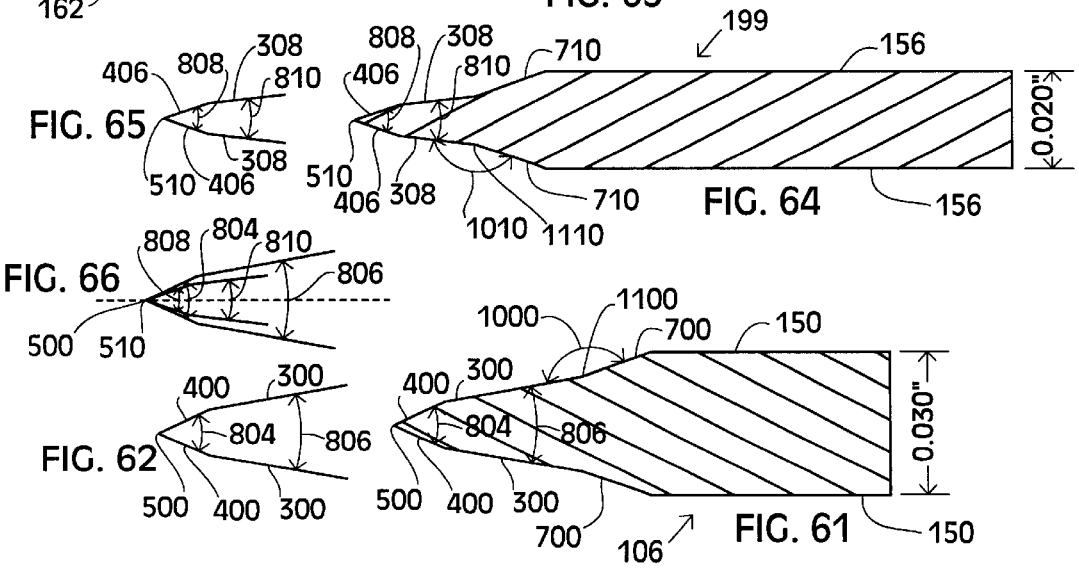
FIG. 65
FIG. 64
FIG. 66
FIG. 62
FIG. 61

CUTTING BLADE

BACKGROUND—FIELD OF THE INVENTION

This invention relates generally to cutting blades, sharper cutting blades and particularly to sharper arrowhead or broadhead cutting blades.

BACKGROUND—DESCRIPTION OF PRIOR ART

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight by causing it to rotate. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

Arrowheads used for hunting generally kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The sharper the cutting edge of the arrowhead blade(s) (all other factors being equal) the greater the depth of penetration will be.

A cutting edge of a cutting blade, such as those used with hunting arrowheads is formed on a section of blade-stock material by grinding or otherwise fabricating an acute angle along an edge of the blade stock material. This process usually forms a bevel or bevels on both opposing side faces of the blade-stock material. Generally, the sharpness of an arrowhead cutting blade (all other factors being equal) is determined by the angle between opposing bevels on either side of the cutting edge of the blade; the narrower the angle between the opposing bevels the sharper the cutting edge is. A common method for manufacturing arrowhead blades is the process of strip grinding, wherein generally a pair of primary grind bevels is first ground on opposing sides of the metal strip (blade stock material) so that an acute angle (the cutting edge) is created along an edge of strip, whereupon a pair of hone grind bevels is generally ground on the primary grind bevels so as to yet further define the cutting edge with another acute angle, and lastly the cutting edge is generally stropped—wherein microscopic burrs are removed from the cutting edge.

A common type of arrowhead used in hunting is the fixed-blade arrowhead, which has a pointed tip end used for penetrating, and generally triangular shaped fixed-blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots.

The tip of the arrowhead may be separably attachable to the arrowhead body or may be integral with it. Arrowheads for hunting are generally known as broadheads. Some types of fixed-blade arrowheads have a cutting blade extending to the forward terminus of the arrowhead, such as flathead arrowheads and traditional cut-on-contact arrowheads.

Another popular type of arrowhead for hunting is the blade-opening arrowhead. Blade-opening arrowheads are generally known as mechanical broadheads. Blade-opening arrowheads, like conventional fixed-blade arrowheads generally have an elongate arrowhead body, a tip end, and a threaded opposite end. The blades of blade-opening arrowheads have an attachment end which attaches the blades to the arrowhead body by a shaft or a pivot pin, so that the blades can pivot, rotate or expand between a closed position and an open position. Blade-opening arrowhead blades are generally an elongate substantially rectangular shape and also have a free non-attached end situated opposite the attachment end. The blades of blade-opening arrowheads are also received in blade slots, which are machined or formed into the arrowhead body. The expandable or pivotal blades of blade-opening arrowheads are held in the closed position while in-flight, until the arrowhead penetrates a game animal or target, by various different methods including: conventional rubber O-rings, rubber bands, tight fitting plastic sleeves, tape, heat-shrinkable sleeves, and other wrap materials as well as by magnetism, various spring systems, friction detents and other frictional mechanisms. When the expanding blades of blade-opening arrowheads are retracted or folded into the closed position, a substantial majority of each blade is generally housed within its corresponding blade slot. This feature gives blade-opening arrowheads the ability to attain significantly increased aerodynamic performance over fixed-blade arrowheads, due to the significantly decreased exposure the retracted blades have with the air when the arrow is rotating while in flight. Such increased aerodynamic performance results in the desirable features of: faster shooting arrows, flatter arrow trajectories, increased penetration energy and enhanced repeatability of accuracy, while also providing a wide diameter cut in the game animal when the razor sharp blades open at impact with the animal.

Blade-opening arrowheads come in a variety of different types and styles. The most common type of blade-opening arrowhead has blades that are pivotally connected to the arrowhead body at a location near the rear end of the arrowhead body. This makes it so that when the blades are folded into the retracted position a leading blade end of each blade positioned near the tip of the arrowhead protrudes outward from the arrowhead body. The leading blade ends of such blade-opening arrowheads rotate or expand away from the arrowhead body in a rearward direction when penetrating an animal. Particularly, the leading blade ends catch on the animal's surface and serve to lever or rotate the blades into the fully open position, thus exposing the sharp cutting edges of the blades to a fully open cutting diameter position and cutting the animal. Another type of blade-opening arrowhead has pivotal blades that rotate or expand in a forward direction to the fully open position when penetrating an animal. The blades of these forward blade rotating/expanding blade-opening arrowheads are rotated or expanded toward the open position by a variety of different mechanisms, but all also define a fully open cutting diameter when in the open position.

Yet another type of arrowhead used for hunting has pivotal blades that are exposed at a full cutting diameter position while the arrowhead is in-flight. Such arrowheads also generally achieve better aerodynamic performance than fixed-blade arrowheads because by design each pivotal blade only attaches to a corresponding arrowhead body at a single location so that with their substantially elongate shaped blades such arrowheads have significantly decreased blade surface area exposure with the air while in-flight.

Arrowheads having expanding blades, or cutting blades attached to an arrowhead body by a pin or a shaft, like most blade-opening arrowheads, generally need to have thicker blades for strength purposes than that of fixed-blade arrowhead blades. This is such because expanding or pivotal blades are generally attached to corresponding arrowhead bodies at only one location (the pin) and therefore can more readily be damaged by the high impact forces encountered at target penetration from impacting bone and/or other similar materials than can the blades of fixed-blades arrowheads which are contrastingly attached to corresponding arrowhead bodies in a manner so as to contact the arrowhead body along a substantial majority of their length which therefore generally provides a greater support structure and sufficient strength for the thinner blade(s).

It is desirable for an arrowhead to penetrate as deep in the game animal as possible so as to maximize the volume of animal tissue that is cut, as well as to create both an entry hole and an exit hole in the animal for blood to drain therefrom so as to leave a more followable or noticeable blood trail.

It is desirable for an arrowhead blade or broadhead blade to be as sharp as possible so as to better cut game animals and therefore provide a more lethal broadhead.

The sharpness, or narrowness of the angle between opposing bevels on either side of the cutting edge of a cutting blade, such as a broadhead cutting blade, is generally determined by the thickness of the blade stock material the repsective cutting blade is made from. Generally, thinner blade stock material will produce a narrower angle between opposing bevels than will thicker blade-stock material, and thus since the angle is narrower the cutting edge is sharper (all other factors being equal).

Therefore, since mechanical broadhead blades are generally thicker than fixed-blade broadhead blades for strength purposes, mechanical broadhead blades generally do not have as sharp of cutting edges (as narrow of angle between opposing grind bevels) as do fixed-blade broadhead blades. Also, thicker blades require more time to grind when sharpening, and thus are more expensive to produce.

It is apparent that there is a need for a sharper cutting blade. It is apparent that there is a need for an improved cutting blade for broadheads. It is apparent that there is a need for a thicker cutting blade which has both the increased structural strength and rigidity of a thicker blade, as well as having the sharper cutting edge (narrower angle between bevels) as does a thinner cutting blade.

It is also apparent that there is a need to more cost effectively manufacture cutting blades by reducing the time to grind/sharpen cutting edge(s) thereon, wherein the amount of time to grind/sharpen a cutting edge on a thicker cutting blade is reduced to the amount of time required to grind/sharpen a cutting edge on a thinner cutting blade.

SUMMARY OF THE INVENTION

It is an object of the present invention to provide a sharper cutting blade.

It is an object of the present invention to more cost effectively manufacture cutting blades by reducing the time to grind/sharpen cutting edge(s) thereon, wherein the amount of time to grind/sharpen a cutting edge on a thicker cutting blade is reduced to the amount of time required to grind/sharpen a cutting edge on a thinner cutting blade.

It is an object of the present invention to provide a sharper cutting blade having a cutting edge section that is not collinear with another cutting edge section of the cutting blade.

It is an object of the present invention to provide a sharper cutting blade having a cutting edge with at least a portion thereof that is substantially serrated.

It is an object of the present invention to provide a cutting blade having a cutting edge with an angle between opposing hone bevels that is substantially the angle normally attainable between hone bevels on cutting blades having thinner cross-sectional thicknesses.

It is an object of the present invention to provide a cutting blade having a cutting edge with an angle between opposing primary grind bevels that is substantially the angle normally attainable between primary grind bevels on cutting blades having thinner cross-sectional thicknesses.

It is an object of the present invention to provide a cutting blade having a cutting edge with an angle between opposing grind bevels that is substantially the angle normally attainable between grind bevels on cutting blades having thinner cross-sectional thicknesses.

It is an object of the present invention to provide a sharper razor blade.

It is an object of the present invention to provide a sharper shaving razor blade.

It is an object of the present invention to provide a sharper shaving razor blade that has the cutting edge of a thinner shaving blade and the rigidity of a thicker shaving blade.

It is an object of the present invention to provide a sharper utility blade.

It is an object of the present invention to provide a sharper surgical scalpel blade.

It is an object of the present invention to provide (a) sharper device(s) for cutting, slitting, trimming, chopping and dicing.

It is an object of the present invention to provide a sharper arrowhead cutting blade.

It is an object of the present invention to provide a sharper fixed-blade arrowhead cutting blade.

It is an object of the present invention to provide a sharper fixed-blade arrowhead cutting blade that is removably attachable with an accompanying arrowhead body.

It is an object of the present invention to provide a sharper fixed-blade arrowhead cutting blade that is non-removably attachable with an accompanying arrowhead body.

It is an object of the present invention to provide a sharper fixed-blade arrowhead cutting blade that is integral with an accompanying arrowhead body.

It is an object of the present invention to provide a sharper blade-opening arrowhead cutting blade.

It is an object of the present invention to provide a sharper blade-opening arrowhead cutting blade that is removably attachable with an accompanying arrowhead body.

It is an object of the present invention to provide a sharper cutting blade that attaches to a blade-opening arrowhead.

It is an object of the present invention to provide a sharper cutting blade that removably attaches to a blade-opening arrowhead body.

It is an object of the present invention to provide a sharper cutting blade that non-removably attaches to a blade-opening arrowhead body It is an object of the present invention to provide a sharper cutting blade that is integral with a blade-opening arrowhead body.

It is an object of the present invention to neck down an edge of blade stock material, from which a thicker cutting blade would be fabricated from before a cutting edge is sharpened, to the thickness of a narrower blade, and then grinding or sharpening the thinner necked down edge section so as to provide a blade having the structural strength and/or rigidity of a thicker blade with a sharper or narrower angled cutting edge than it would of normally had.

It is an object of the present invention to neck down an edge of blade stock material, from which a thicker cutting blade would be fabricated from before a cutting edge is sharpened, to the thickness of a narrower blade, and then grinding or sharpening the thinner necked down edge so as to provide a blade having the structural strength and/or rigidity of a thicker blade with a sharper or narrower angled cutting edge that the narrower blade would normally have.

It is an object of the present invention to neck down an edge of blade stock material, from which a thicker cutting blade would be fabricated from before the cutting edge is sharpened, to the thickness of a narrower blade, and then grinding or sharpening the thinner necked down edge section so as to provide a blade having the structural strength and/or rigidity of a thicker blade with a sharper or narrower angled cutting edge than it would of normally had.

It is an object of the present invention to neck down an edge of blade stock material, from which a thicker cutting blade would be fabricated from before the cutting edge is sharpened, to the thickness of a narrower blade, and then grinding or sharpening the thinner necked down edge so as to provide a blade having the structural strength and/or rigidity of a thicker blade with a sharper or narrower angled cutting edge that the narrower blade would normally have.

It is an object of the present invention to provide a cutting blade fabricated from blade stock material having a plurality of different cross-sectional thicknesses before cutting edge sharpening.

It is an object of the present invention to provide a cutting blade having a side face and a cutting edge, where an inside corner is disposed between the cutting edge and the side face.

It is an object of the present invention to provide a cutting blade having a side face and a cutting edge, where an inclined bevel and an inside corner are disposed between the cutting edge and the side face.

It is an object of the present invention to provide a cutting blade having a side face and a cutting edge, where a plurality of different inclined bevels and an inside corner are disposed between the cutting edge and the side face.

It is an object of the present invention to provide a cutting blade having a side face and a cutting edge, where a plurality of different inclined bevels and an inside corner are disposed between the cutting edge and the side face on one side of the cutting edge, and at least one other bevel is disposed on another side of the cutting edge.

It is an object of the present invention to provide a cutting blade having a pair of opposing side faces on either side of a cutting edge, where an inside corner is disposed between the cutting edge and each side face.

It is an object of the present invention to provide a cutting blade having a pair of opposing side faces on either side of a cutting edge, where an inclined bevel and an inside corner are disposed between the cutting edge and each side face.

It is an object of the present invention to provide a cutting blade having a pair of opposing side faces on either side of a cutting edge, where a plurality of different inclined bevels and an inside corner are disposed between the cutting edge and each side face.

It is an object of the present invention to provide a process for manufacturing a cutting blade wherein blade stock material is necked down, along the edge of the blade stock material a cutting edge will be sharpened on, to a narrower thickness, and then at a later time grinding or sharpening a cutting edge on the thinner necked-down edge section.

It is an object of the present invention to provide a process for manufacturing a cutting blade wherein blade stock material is necked down, along the edge of the blade stock material a cutting edge will be sharpened on, before the blade stock material is in the annealed condition, to a narrower thickness, and then at a later time grinding or sharpening a cutting edge on the thinner necked-down edge section.

It is an object of the present invention to provide a process for manufacturing a cutting blade wherein blade stock material is necked down, along the edge of blade stock material a cutting edge will be sharpened on, when the blade stock material is in the annealed condition, to a narrower thickness, and then at a later time grinding or sharpening a cutting edge on the thinner necked-down edge section.

It is an object of the present invention to provide a process for manufacturing a cutting blade wherein blade stock material is necked down, along the edge of blade stock material a cutting edge will be sharpened on, to a narrower thickness, then hardening the blade stock material, and then grinding or sharpening a cutting edge on the thinner necked-down edge section.

It is an object of the present invention to provide a strip grinding process for manufacturing a cutting blade wherein blade stock strip material is necked down, along the edge of the strip a cutting edge will be sharpened on, to a narrower thickness, and then at a later time grinding or sharpening a cutting edge on the thinner necked-down edge section.

It is an object of the present invention to provide a strip grinding process for manufacturing a cutting blade wherein blade stock strip material is necked down, along the edges of the strip, cutting edges will be sharpened on, to a narrower thickness, and then at a later time grinding or sharpening cutting edges on the thinner necked-down edge sections.

It is an object of the present invention to provide a strip grinding process for manufacturing cutting blades where a plurality of blade stock material strips are fabricated from a single larger sheet (or equivalent) wherein the sheet is necked down along a plurality of spaced apart locations at where cutting edges of the corresponding strips will be sharpened thereon, to a narrower thickness, and then at a later time grinding or sharpening cutting edges on the thinner necked-down edge sections.

It is an object of the present invention to provide a strip grinding process for manufacturing cutting blades where a plurality of blade stock material strips are fabricated from a single larger sheet (or equivalent) wherein the sheet is necked down, by rolling or swaging or stamping, along a plurality of spaced apart locations at where cutting edges of the corresponding strips will be sharpened thereon, to a narrower thickness, then separating the sheet into blade stock material strips, and at a later time grinding or sharpening cutting edges on the thinner necked-down edge sections.

It is still further an object of the present invention to provide a blade stamping process for strip grinding blade manufacture wherein a plurality of blade stock material strips are stamped simultaneously in the same stamping operation wherein the strips each have at least one necked down edge section of a cross-sectional thickness less than the cross-sectional thickness of at least another different section of the corresponding strip, and where at a later time cutting edges are formed or ground on the thinner necked-down edge sections.

It is still further an object of the present invention to provide a process for manufacturing a cutting blade wherein blade forms or blade shapes are stamped into blade stock material and then the blade forms are necked down along an edge thereof that a cutting edge will be sharpened on, to a narrower thickness, and then at a later time grinding or sharpening a cutting edge on the thinner necked-down edge section.

It is yet still further an object of the present invention to provide a process for manufacturing a cutting blade wherein blade forms or blade shapes are stamped into blade stock material and then the blade forms are necked down by rolling or swaging along an edge thereof that a cutting edge will be sharpened on, when the blade stock material is in a non-hardened condition, to a narrower thickness, and then at a later time grinding or sharpening a cutting edge on the thinner necked-down edge section.

It is still further an object of the present invention to provide a process for manufacturing a cutting blade wherein blade forms or blade shapes are stamped into blade stock material and then the blade forms are necked down by rolling or swaging, along the edges thereof that cutting edges will be sharpened on, when the blade stock material is in a non-hardened condition, to a narrower thickness, and then at a later time grinding or sharpening cutting edges on the thinner necked-down edge sections.

It is still further an object of the present invention to provide a process for manufacturing a cutting blade wherein blade stock material is necked down by stamping with a blade stamping die along the edge of the blade stock material a cutting edge will be sharpened on when the blade stock material is in a non-hardened condition, to a narrower thickness, and then at a later time grinding or sharpening a cutting edge on the thinner necked-down edge section.

It is yet still further an object of the present invention to provide a strip grinding process for manufacturing a cutting blade wherein blade stock material is necked down by stamping with a blade stamping die along the edge of the blade stock material a cutting edge will be sharpened on when the blade stock material is in a non-hardened condition, to a narrower thickness, and then at a later time grinding or sharpening a cutting edge on the thinner necked-down edge section.

It is yet still further an object of the present invention to provide a process for manufacturing a cutting blade wherein blade stock material is necked down by rolling at least a section of the edge of blade stock material a cutting edge will be sharpened on when the blade stock material is in a non-hardened condition, to a narrower thickness, and then at a later time grinding or sharpening a cutting edge on the thinner necked-down edge section.

It is even yet still further an object of the present invention to provide a process for manufacturing a cutting blade wherein blade stock material is necked down, by grinding along the side faces adjacent the edge of the blade stock material a cutting edge will be sharpened on, to a narrower thickness, and then at a later time grinding or sharpening a cutting edge on the thinner necked-down side face section or edge section.

The foregoing objects and advantages and other objects and advantages of the present invention are accomplished as according to some of the preferred embodiments of this invention with a mechanical broadhead blade made from 440C stainless steel having a thickness of 0.030" (inches) with a cutting edge that was ground on a necked down approximately 0.020" (inch) thick edge portion thereof during a strip grinding process. The blade has a pair of opposing side faces and an inside corner and a step disposed between each side face and the cutting edge. The cutting edge of the blade comprises a pair of opposing primary grind bevels, and a pair of opposing hone bevels. The cutting edge was stropped with leather wheels (or equivalent) to remove microscopic burrs from hone bevel grinding. The angle between the opposing primary grind bevels is approximately 20 degrees and the angle between the opposing hone bevels is approximately 24 degrees. The bevels and steps may be flat or convex or concave or any combination thereof, as viewed in a cross-section of the cutting edge. This provides a 0.030" thick mechanical broadhead blade, which is of a thickness preferred for blade-opening arrowhead expandable blades due to structural and strength issues, having a much sharper cutting edge (narrower angle between cutting edge bevels) than what standard 0.030" thick blades in the industry normally have; which for example could be generally approximately 30 degrees between primary grind bevels, and approximately 40 degrees between hone bevels.

The 0.030" thick 440C stainless steel mechanical broadhead blade as described above, was fabricated from a 0.030" thick, 440C stainless steel strip (blade stock material—material cutting blades will be fabricated from) that had an edge section thereof necked down to approximately 0.020" when the strip was still in a soft condition (not heat treated/hardened yet). The strip was then hardened and the cutting edge was ground on the necked down 0.020" thinner edge section. The necking down process of the strip edge section could be accomplished before, after or during stamping/cutting the blade shapes or blade forms (precursor blade articles) into the strip during the blade die stamping process. Such method of obtaining an improved sharper blade is manufacturally feasible and cost effective, and would not require excessive grinding time to give the thicker 0.030" blade the normal cutting edge angles of a thinner 0.020" blade, while allowing it to retain the normal structural strength, rigidity and integrity of a 0.030" thick blade.

Another preferred embodiment of this invention comprises a replaceable fixed-blade broadhead blade made from 440C stainless steel having a thickness of 0.027" with a stropped cutting edge that was ground on an approximately 0.020" thick edge portion thereof during a strip grinding process. The 0.027" fixed-blade also has a pair of opposing side faces with an inside corner disposed between each side face and the cutting edge, a pair of opposing primary grind bevels, a pair of opposing hone bevels and an approximately 20 degree angle between the opposing primary grind bevels as well as an approximately 24 degree angle between the opposing hone bevels. This provides a fixed-blade broadhead blade with a 0.027" thickness that is substantially stronger than 0.020" thick fixed-blade broadhead blades, but that has the much sharper cutting edge (narrower angle between cutting edge bevels) than what standard 0.027" thick blades in the archery industry normally have.

The angles between the opposing pairs of like bevels could be different than those set forth above in various different embodiments of this invention, but generally the bevel angles ground/formed on thinner blade stock material sections will be less than the bevel angles ground/formed on thicker blade stock material sections.

Other preferred embodiments as according to this invention include blades and blade stock material having various different thicknesses, such as in the range of 0.002" to 0.009" for shaving razor blades for example, and up to one inch or more, but not limited to.

Other preferred embodiments as according to this invention have blades with cutting edges that are not monolinear, such as that which are at least in part serrated, substantially totally serrated, toothed, round, wavy, scalloped, internally or concavely curved/hooked, exteriorly or convexly curved, having a plurality of linear segments that are not collinear with one another, or any plausible combination thereof.

Yet other preferred cutting blade embodiments as according to this invention have cutting edges with only one grind bevel on either side of the cutting edge thereof, whereas other cutting blade embodiments do not.

Yet other preferred cutting blade embodiments as according to this invention have cutting edges with a grind bevel, or grind bevels on one side of the cutting edge and no grind bevels (or equivalents) on the other side of the cutting edge.

Yet other preferred cutting blade embodiments as according to this invention have cutting edges with an inside corner on both sides of the cutting edge, whereas other cutting blade embodiments have an inside corner on only one side of the cutting edge.

Yet other preferred cutting blade embodiments as according to this invention have the blade forms or blade shapes laser cut, water-jet cut, or otherwise cut from a sheet (or equivalent) of blade stock material so as to not be stamped nor fabricated in a strip grinding process.

Yet other preferred cutting blade embodiments as according to this invention have at least one cutting edge formed thereon during a strip grinding process and at least one other cutting edge formed thereon by a non-strip grinding process, such as by a multi-axis CNC grinder.

The cutting blades as according to the desired results and scope of this invention have sharper cutting edges than prior art cutting blades.

The cutting blades as according to the desired results and scope of this invention have sharper cutting edges and are more rigid and structurally strong than prior art cutting blades with similar sharpnesses of cutting edges, or angles between opposing bevels.

The cutting blades as according to the desired results and scope of this invention enable thicker cutting blades to be produced more economically.

The cutting blades as according to the desired results and scope of this invention enable thicker cutting blades having acuter cutting edges to be produced more economically.

The arrowhead cutting blades as according to the desired results and scope of this invention are more lethal than prior art conventional arrowhead cutting blades in that they provide a sharper cutting edge, so as to better cut the game animals and therefore maximize penetration and lethality.

As has been shown in the above discussion, the cutting blades of the arrowheads and the cutting blades of the other cutting devices as according to this invention overcome deficiencies inherent in prior art cutting blades.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 1 is a side view of a fixed-blade arrowhead blade;

FIG. 2 is a side view of a fixed-blade arrowhead, having replaceable cutting blades;

FIG. 3 is a partially sectioned side view of a blade-opening arrowhead with the expandable blades in the closed position;

FIG. 4 is a side view of a blade-opening arrowhead with the blades in the closed position;

FIG. 5 is a side view of the blade-opening arrowhead of FIG. 4 with the blades in the open position;

FIG. 6 is a side view of a blade-opening arrowhead blade of the arrowhead of FIGS. 4 & 5;

FIG. 7 is a side view of a blade-opening arrowhead blade of the arrowhead of FIG. 3;

FIG. 8 is an enlarged cross-sectional view of the blade stock material the blade of FIG. 7 was made from;

FIG. 9 is an enlarged cross-sectional view of the blade of FIG. 7 as taken along 9—9 of FIG. 7;

FIG. 10 is an outline of the exterior bevel surfaces of the blade of FIG. 7 as seen in the cross-sectional view thereof in FIG. 9;

FIG. 11 is a side view of a fixed-blade arrowhead blade of the arrowhead of FIG. 2;

FIG. 12 is an enlarged cross-sectional view of the blade stock material the blade of FIG. 11 was made from;

FIG. 13 is an enlarged cross-sectional view of the blade of FIG. 11 as taken along 13—13 of FIG. 11;

FIG. 14 is an outline of the exterior bevel surfaces of the blade of FIG. 11 as seen in the cross-sectional view thereof in FIG. 13;

FIG. 15 is a view of the outlines as of FIGS. 10 & 14 superimposed upon each other;

FIG. 16 is a side view of a blade-opening arrowhead blade as according to this invention;

FIG. 17 is an enlarged cross-sectional view of the blade stock material the blade of FIG. 16 was made from;

FIG. 18 is a cross-sectional view of the blade stock material of FIG. 17 that has been necked down;

FIG. 19 is an enlarged cross-sectional view of the blade of FIG. 16 as taken along 19—19 of FIG. 16;

FIG. 20 is an enlarged cross-sectional view of a section of blade stock material a cutting blade as according to this invention is made from;

FIG. 21 is a cross-sectional view of the blade stock material of FIG. 20 that has been necked down as according to this invention;

FIG. 22 is a cross-sectional view of a cutting blade as according to this invention fabricated from the necked down blade stock material as of FIG. 21;

FIG. 23 is an enlarged cross-sectional view of blade stock material a cutting blade as according to this invention is made from;

FIG. 26 is an enlarged cross-sectional view of blade stock material a blade as according to this invention is made from;

FIG. 60 is a side view of the section of necked down blade stock material strip after die stamping with the blade forms or blade shapes cut out and remaining attached to the strip as of FIG. 52 having the cutting edge formed thereon as according to this invention;

FIG. 61 is an enlarged cross-sectional view of the sharpened blade shape/form of the strip as of FIG. 60 as taken along 61—61;

FIG. 62 is an outline of the exterior bevel surfaces of the sharpened blade edge of FIG. 61;

FIG. 63 is a side view of the section of necked down blade stock material strip after die stamping with the blade forms or blade shapes cut out and remaining attached to the strip as of FIG. 54 having the cutting edge formed thereon as according to this invention;

FIG. 64 is an enlarged cross-sectional view of the sharpened blade shape/form of the strip as of FIG. 63 as taken along 64—64;

FIG. 65 is an outline of the exterior bevel surfaces of the sharpened blade edge of FIG. 64;

FIG. 66 is a view of the outlines as of FIGS. 62 & 65 superimposed upon each other;

FIG. 67 is an enlarged cross-sectional view of blade stock material a blade as according to this invention is made from;

DETAILED DESCRIPTION OF THE PREFERRED EMBODIMENTS

Figure 23:
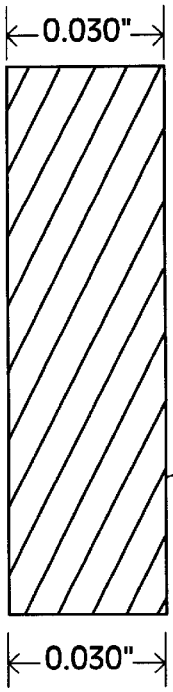
Figure 24:
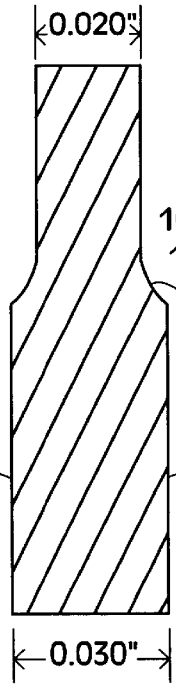
FIG. 24 is a cross-sectional view of the blade stock material of FIG. 23 that has been necked down.

FIG. 1 illustrates a replaceable blade, fixed-blade arrowhead cutting blade 100 having a cutting edge 500, a pair of primary grind bevels 300, and a pair of hone bevels 400 (only one primary grind bevel 300, and one hone bevel 400 is illustrated in the side view of blade 100 as per FIG. 1).

FIG. 2 illustrates a fixed-blade arrowhead 200 having a plurality of fixed blades 100 removably attached therewith.

FIG. 3 illustrates a blade-opening arrowhead (mechanical broadhead) 202 having a plurality of expanding cutting blades 104 removably attached therewith, and a plurality of fixed blades removably attached within a tip located at the forward leading end of the arrowhead, as for example as is taught in my U.S. patent application Ser. No. 09/082,636 filed May 21, 1998 which is incorporated herein by specific reference.

FIGS. 4 & 5 illustrate a blade-opening arrowhead 204 having a plurality of expanding blades 102 removably attached therewith. FIG. 6 illustrates a pivotal or expanding blade 102.

Blades 100, 102 & 104 have conventional or prior art cutting edge configurations thereon as will be illustrated herein. Blades 100, 102 & 104 may be sharpened during a strip grinding process, wherein generally a first inclined section or bevel (primary grind bevel) is ground on both sides of the precursor blade article (blade shape or blade form—blade stock material), such as primary grind bevels 300 of blade 100 as illustrated in FIG. 1, then a second inclined section or bevel (hone bevel) is ground on both sides of the precursor blade article or blade shape, such as hone bevels 400 of blade 100 as illustrated in FIG. 1, and lastly the cutting edge is stropped to remove microscopic burrs produced from grinding so as to create a finished cutting blade. The angle between opposing primary grind bevels is narrower than the angle between opposing hone bevels, as referenced in a plane perpendicular to the blade cutting edge (see FIGS. 9, 10 & 13–15 and the discussion herebelow).

It is apparent that the grind bevels, such as primary grind bevels and/or hone bevels, or equivalents, of the cutting edges as according to the cutting blades of this invention may be convex or flat or concave like unto hollow-ground, or combinations thereof, as generally referenced when corresponding cutting edges are viewed in cross-section, but not limited thereto.

FIG. 7 illustrates a pivotal blade 104 of blade-opening arrowhead 202 having a pair of primary grind bevels 302 (one per each side), a pair of hone bevels 402, a cutting edge 502 and a pair of opposing side faces 150. FIG. 9 illustrates a cross-section of blade 104. FIG. 10 illustrates an outline of the exterior surface of primary grind bevels 302 and hone bevels 402 of blade 104 as illustrated in perpendicular cross-section of blade 104 as per FIG. 9. As illustrated in FIG. 10, an angle 800 depicts the angle between opposing hone bevels 402, and an angle 802 depicts the angle between opposing primary grind bevels 302 of blade 104, thus defining the sharpness of cutting edge 502.

FIG. 8 illustrates the blade stock material 680 (section of stamped strip—herein discussed below) that blade 104 was fabricated from before cutting edge sharpening thereof. Blade stock material 680 is 0.030 inches (") thick. The notation (") as used throughout this specification means inches when placed adjacent numbers denoting a measurement or thickness.

Figure 44:
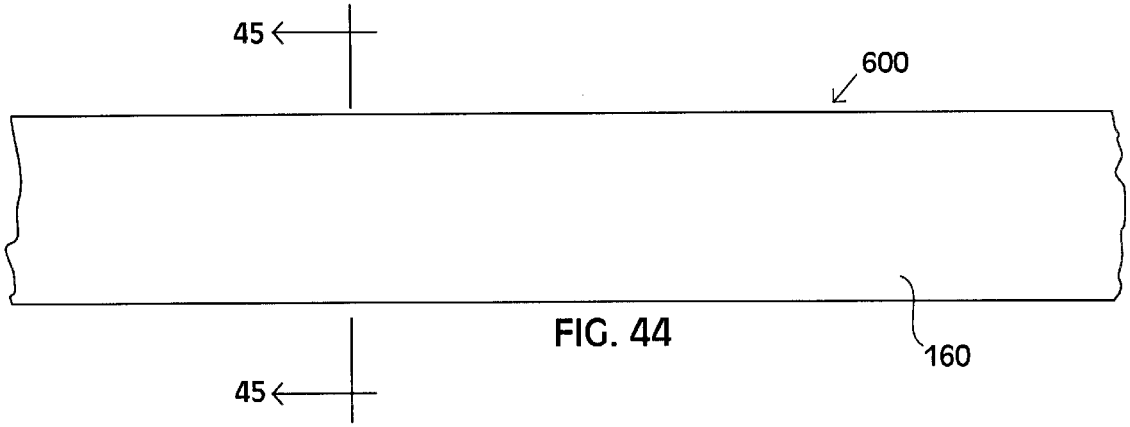
FIG. 44 is a side view of a section of blade stock material strip for use in strip grinding manufacture of cutting blades as according to at least some of the embodiments of this invention.
Figure 46:
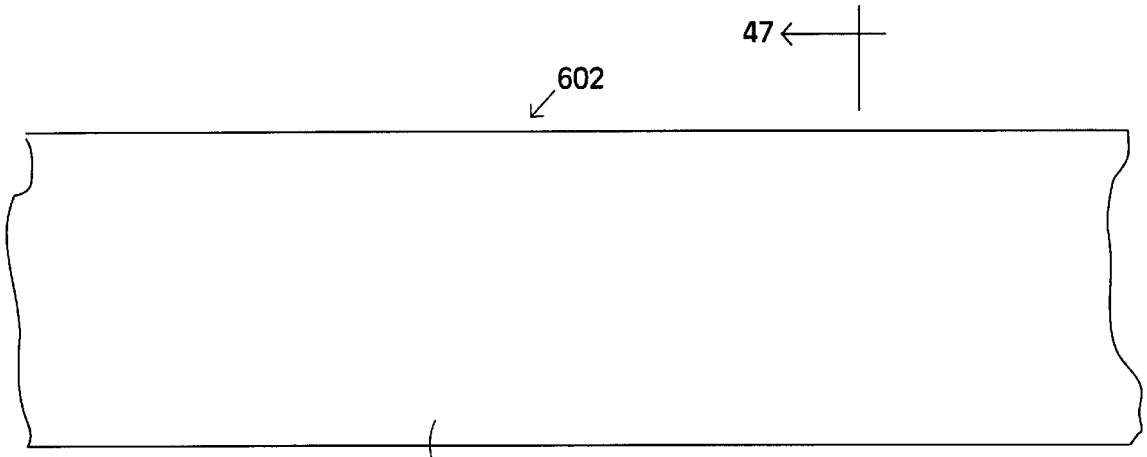
FIG. 46 is a side view of a section of blade stock material strip for use in strip grinding manufacture of cutting blades as according to at least some of the embodiments of this invention.

It is to be noted that blade stock material sections as according to this invention, such as blade stock material 680 and other blade stock material sections numbered subalphabetically thereof (i.e. 680*a*, 680*b*, 680*c* etc), and strip grinding strips sections discussed herebelow which are numbered 600, 602 as well as subalphabetical numbered variations thereof (i.e. 600*a*, 600*b*, etc & 602*a*, 602*b*, etc) as according to some of the preferred embodiment variations hereof, could be referring to (but not limited to) the same sections of blade stock material, despite having different reference numerals. For example, a blade stock material section 680 as of FIG. 8 could be a section of strip 600 as of FIG. 44, or blade stock material section 680 as of FIG. 8 could specifically not be a section of strip 600, depending on the specific embodiment and/or manufactural procedural situation of this invention.

It is apparent that the cutting blades as according to this invention may be fabricated and/or sharpened at least in part in a strip grinding process, or entirely in a strip grinding process or by methods or processes not involving strip grinding.

FIG. 11 illustrates fixed-blade 100 of arrowhead 200 as of FIG. 2, wherein primary grind bevels 300 (one per each side), hone bevels 400, cutting edge 500 and a pair of opposing side faces 152 are depicted. FIG. 13 illustrates a cross-section of blade 100. FIG. 14 illustrates an outline of the exterior surface of primary grind bevels 300 and hone bevels 400 of blade 100 as illustrated in perpendicular cross-section of blade 100 as per FIG. 13. As illustrated in FIG. 14, an angle 804 depicts the angle between opposing hone bevels 400, and an angle 806 depicts the angle between opposing primary grind bevels 300 of blade 100, thus defining the sharpness of cutting edge 500.

FIG. 12 illustrates the blade stock material 682 (section of stamped strip) that blade 100 was fabricated from before cutting edge sharpening thereof. Blade stock material 682 is 0.020" thick.

As is evident from FIG. 15, where the outlines of bevel exterior surfaces as of FIGS. 10 & 14 are superimposed upon each other, cutting edge 500 of blade 100 is sharper (has narrower angles between corresponding bevels) than cutting edge 502 of blade 104.

As set forth above, blades 100, 102 & 104 have conventional or prior art cutting edge configurations, wherein the angle defined between a first inclined section which is furthest from the cutting edge on a first side of the cutting blade and the exterior surface of the blade directly opposite therefrom on a second side of the cutting blade, is smaller than the angle between a second inclined section (also on the first side of the cutting blade) just closer toward the cutting edge from the first inclined section and the exterior surface of the blade directly opposite therefrom on the second side of the cutting blade. As for example, blades 100, 102 & 104 have pairs of opposing first and second inclined sections (such as the bevels depicted herein), wherein the angle between the pair of inclined section (bevels) furthest from the cutting edge is smaller than the angle between the pair of inclined sections (bevels) just closer toward the cutting edge, from the pair of inclined sections that are furthest from the cutting edge.

Blades 100, 102 & 104 have generally double bevel cutting edges as is known to those skilled in the art, wherein a bevel is formed on both sides of the cutting edge of each blade of the respective blades thereof. It is apparent that the scope and functional objective desired results as according to this invention are attainable with single bevel cutting edges and single bevel cutting blades, wherein a bevel or bevels is/are disposed on only one side of the respective cutting edge(s) of such blades.

FIG. 16 illustrates a pivotal blade 106 which could be used with blade-opening arrowhead 202 in place of blades 104. Blade 106 has a pair of inclined steps 700 (one per each side), a pair of primary grind bevels 300, a pair of hone bevels 400, a cutting edge 500, and a pair of opposing side faces 150. It is to be noted that primary grind bevels 300, hone bevels 400, and cutting edge 500 of blade 106 are the same (within manufacturing repeatability tolerances) as primary grind bevels 300, hone bevels 400, and cutting edge 500 of blade 100 as is readily apparent from FIG. 19 as discussed herebelow.

FIG. 19 illustrates a cross-section of blade 106 which has a widest thickness (as referenced in perpendicular cross-section) of 0.030" (inches). As also illustrated in FIG. 19, blade 106 has the same angles 804 & 806 between corresponding opposing primary grind bevels 300 and between corresponding opposing hone bevels 400, as does 0.020" thick blade 100. Thus, expandable blade 106 has a sharper cutting edge 500 than cutting edge 502 of expandable blade 104, and yet expandable blade 106 is just as strong and rigid as expandable blade 104 so as to be an improvement over the prior art as is according to the scope and desired results of this invention.

It is to be noted from FIG. 19, that the angle between opposing inclined steps 700 is larger than the angle between the pair of opposing inclined sections just closer to cutting edge 500 from steps 700 of blade 106. Which contrastingly as discussed hereabove, is just the opposite of the geometry of conventional prior art cutting edges of blades 100, 102 & 104.

As illustrated in FIG. 19, each step 700 of blade 106 forms an inside corner 1100 with the junction of corresponding primary grind bevels 300 so as to define an angle 1000 on either side of cutting edge 500. An inside corner as according to this invention, is defined as having an angle of measure that is less than 180 degrees between adjoining sections. Inside corners as according to this invention are determined generally (but not limited to) in planes perpendicular to a cutting edge of the blade (or equivalent) so as to present a cross-sectional view thereof. The specific shape of the junctions of adjoining blade sections (such as bevels, steps, inclined sections or the like) that create inside corners as according to this invention may be of various different shapes, such as being curved like unto a fillet, being chamfered or pointed.

FIG. 17 illustrates a blade stock material section 680 (a section of the strip—when blade 106 is fabricated at least in part from a strip grinding process) having a uniform cross-sectional thickness of 0.030". FIG. 18 illustrates a necked down blade stock material section 680*a*, which is blade stock material 680 that was necked down so as to have a thinner section (0.020" thick) formed along the edge to be sharpened. Necking down blade stock material 680 creates steps 700 and necked down side faces 900 as illustrated in FIG. 18. As illustrated in FIGS. 16 & 19, when primary grind bevels 300 and hone bevels 400 are ground or formed on strip 680*a*, a cutting blade 106 is created having a thickness of 0.030", yet with the cutting edge angles between bevels of that which a 0.020" thick blade has, as is according to at least some of the embodiments of this invention. Angle 806, as in FIG. 19, between primary grind bevels 300 of blade 106 is approximately 20 degrees (not drawn to scale), and angle 804 between hone bevels 400 of blade 106 is approximately 24 degrees (not drawn to scale). This is in direct contrast to angles 802 & 800 of blade 104, which also has a thickness of 0.030" as illustrated in FIGS. 9 & 10, which angles are approximately 30 degrees and 40 degrees respectively (not drawn to scale).

It is apparent that the angles between opposing bevels or inclined sections such as primary grind bevels, steps, hone bevels and grind bevels or equivalents of the cutting blades as according to this invention may be of various different measurements so as to achieve at least some of the objects as according to the scope of this invention. The angles between opposing bevels or equivalents of the cutting blades as according to this invention may be different than that as set forth in this specification, even for blades of such as which specific thicknesses have been set forth herein. Generally, but not limited to, the bevel angles ground or formed on thinner blade stock material sections will be less than the bevel angles ground or formed on thicker blade stock material sections.

Figure 25:
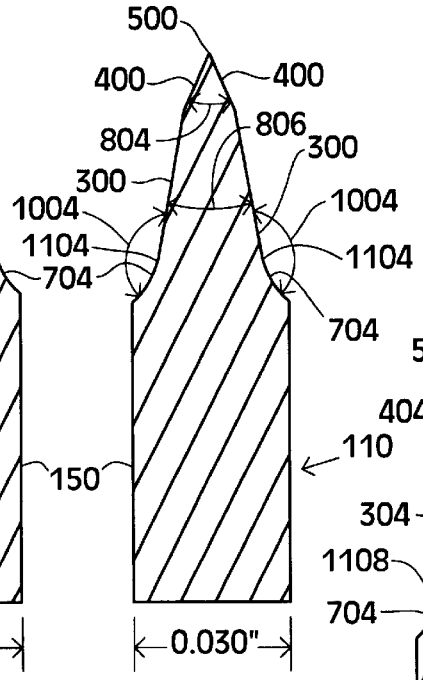
FIG. 25 is a cross-sectional view of a cutting blade as according to this invention fabricated from the necked down blade stock material as of FIG. 24.
Figure 28:
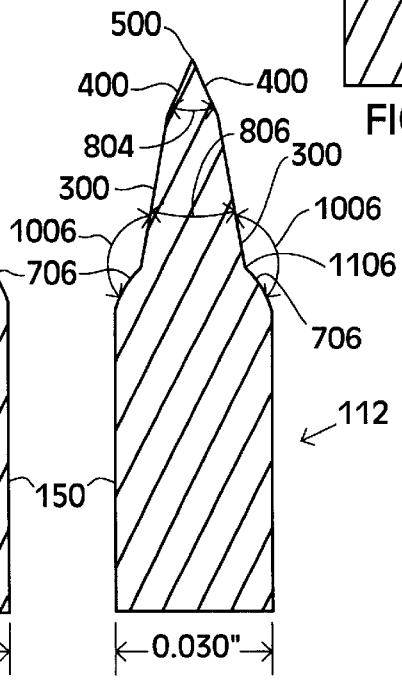
FIG. 28 is a cross-sectional view of a cutting blade as according to this invention fabricated from the necked down blade stock material as of FIG. 27.

Referring again to FIGS. 16–19, it is apparent that the steps or equivalents, such as steps 700 and the necked down side faces or equivalents, such as necked down side faces 900 of blade stock material 680*a*, or other blade stock materials as according to this invention, can be of various different configurations. For example, FIGS. 20–28 illustrate cutting blades and blade stock material having various different shaped steps as is according to at least some of the embodiments of this invention. As illustrated in FIG. 25, a blade 110 has an inclined concave step 704 and an inside corner 1104 which defines an angle 1004 between cutting edge 500 and each side face 150 thereof. FIG. 28 illustrates a blade 112 which has an inclined convex step 706 and an inside corner 1106 which defines an angle 1006 between cutting edge 500 and each side face 150 thereof. It is apparent that the steps or equivalents as according to this invention may be flat, or convex or concave or hollow-ground, or of other configurations or combinations thereof.

Figure 29:
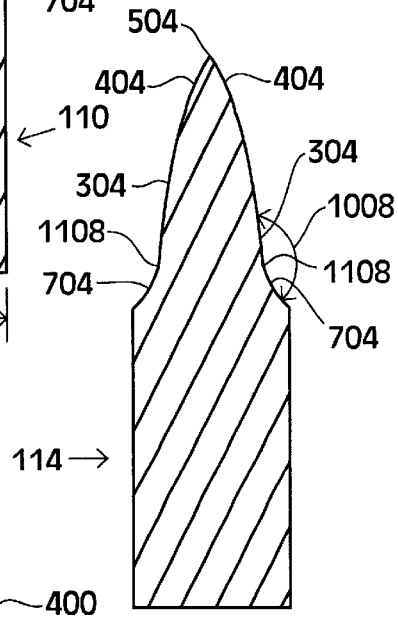
FIG. 29 is an enlarged cross-sectional view of a cutting blade as according to this invention.
Figure 26:
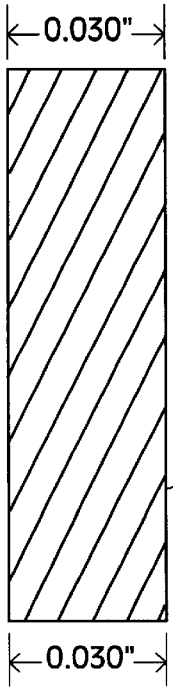
Figure 27:
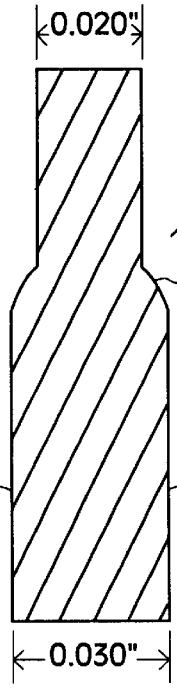
FIG. 27 is a cross-sectional view of the blade stock material of FIG. 26 that has been necked down.

FIG. 29 illustrates a blade 114 which has a pair of inclined convex primary grind bevels 304, and a pair of inclined convex hone bevels 404 as is attainable with strip grinders or strip grinding processes utilizing frustruconical grinding wheels as is known to those skilled in the art. It is apparent that the primary grind bevels and/or hone bevels or equivalents of the cutting blades and the blades or equivalents as according to this invention may be convex, or may be at least in part convex, or may be flat, or concave or of combinations thereof.

It is apparent that the scope and ramifications of this invention can be applied to any type of cutting blade attached or otherwise associated with an arrowhead/broadhead or equivalent.

Figures 30, 30X, 31, 32, 33, 34, 35, 36:
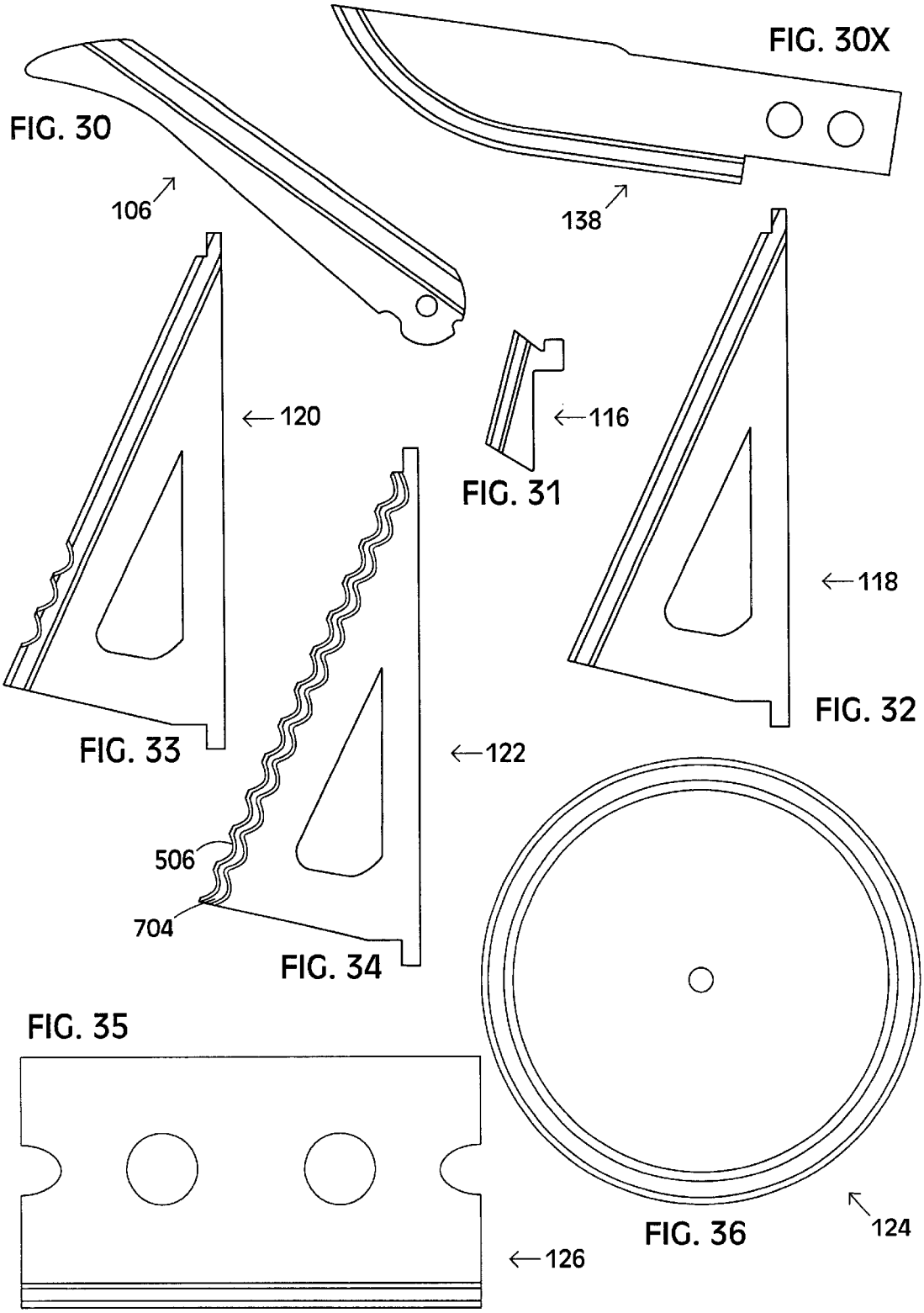
FIG. 30 is a side view of the cutting blade as of FIGS. 16, 19, 60 & 61.
FIG. 30X is a side view of a surgical scalpel cutting blade as according to this invention.
FIG. 31 is a side view of a fixed-blade of a blade-opening arrowhead as according to this invention.
FIG. 32 is a side view of a fixed-blade arrowhead blade as according to this invention.
FIG. 33 is a side view of a fixed-blade arrowhead blade as according to this invention having at least an edge section thereof serrated.
FIG. 34 is a side view of a fixed-blade arrowhead blade as according to this invention with a serrated cutting edge.
FIG. 35 is a side view of a cutting blade as according to this invention.
FIG. 36 is a side view of a cutting blade as according to this invention.

FIGS. 30, 30X & 31–36 illustrate a plurality of cutting blades 116–130 & 138, which have various features of this invention incorporated therewith. Blades 120 and 122 have serrated cutting edges Blade 122 has steps 704 which substantially follow the serrated contour of cutting edge 506 thereof, on both sides of cutting edge 506. FIG. 35 depicts a utility blade or a shaving blade 126. FIG. 36 depicts a circular blade 124. Blade 124 is sharpened on a multi-axis CNC grinder and/or another specialized type of grinder other than a strip grinder. Blade 138 as illustrated in FIG. 30X is a surgical scalpel blade. FIG. 31 depicts blade 116, which could be mounted in the tip of arrowhead 202 as illustrated in FIG. 3.

It is apparent that the scope and ramifications of this invention can be applied to other types of cutting blades, other than broadhead or arrowhead blades, for example cutting blades or equivalents used in at least the following (but not limited to) situations or areas of utility: carpentry, carpeting, electronics, graphic arts, wood working, painting, cabinetry, shipping, archery, hobby & crafts, film & photography, contracting, packaging, tile work, drywall & sheet rocking, medical & surgical, roofing, general industry, food processing, shaving & razors, wood carving, textiles & fiber, gouges, speciality blades, logging, forestry, lumber fabricating, cutting tools and general cutlery & knives.

Figure 37:
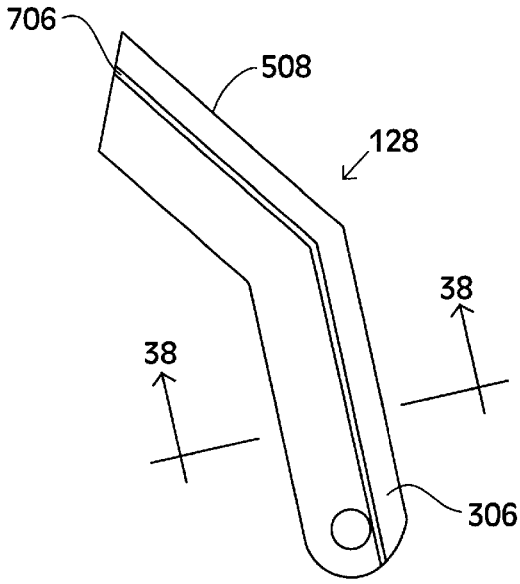
FIG. 37 is a side view of a blade-opening arrowhead cutting blade as according to this invention.
Figure 38:
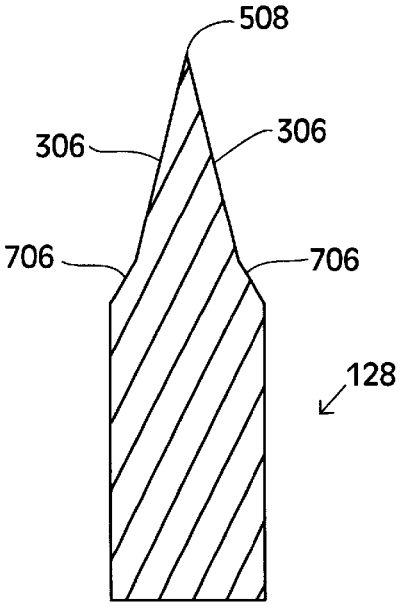
FIG. 38 is an enlarged cross-sectional view of the blade of FIG. 37 as taken along 38—38 of FIG. 37.

FIGS. 37 & 38 illustrate a blade 128 which has a pair of steps 706, and a pair of primary grind bevels 306 which communicate with and define a cutting edge 508 thereof.

Figure 39:
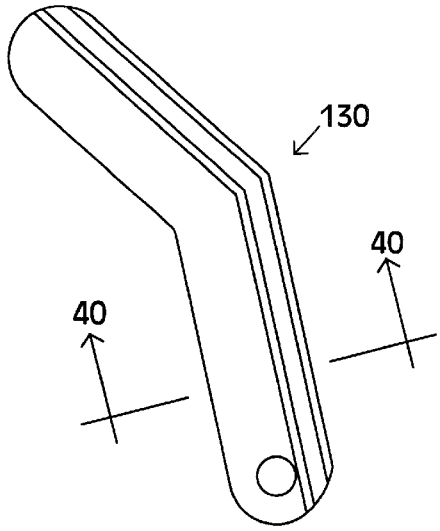
FIG. 39 is a side view of a blade-opening arrowhead cutting blade as according to this invention.
Figure 40:
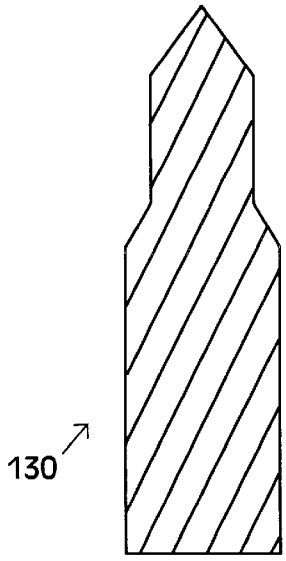
FIG. 40 is an enlarged cross-sectional view of the blade of FIG. 39 as taken along 40—40 of FIG. 39.

FIGS. 39 & 40 illustrate a blade 130 which has a pair of steps, a pair of necked down side faces and a pair of grind bevels so as to define a cutting edge thereof.

It is apparent that blade 128, or blade 130 as illustrated in FIGS. 37–40, or other blades similar thereto, and yet other precursor blade articles (blade shapes or forms—blade stock material) to become razor sharp cutting blades as according to this invention, can be cut out by a laser or by water-jet techniques or the like, before edge sharpening.

It is apparent that the blades and precursor blade articles (blade stock material) as according to this invention, could have one linear cutting edge sharpened thereon by strip grinding and another cutting edge, such as another linear cutting edge, sharpened thereon by a separate secondary sharpening or grinding operation, such as a multi-axis (non-strip grinding) operation or machine.

It is apparent that the cutting blades as according to this invention can be manufactured in a variety of manners. For cutting blades as according to this invention that are fabricated at least in part from a strip grinding process, the strip could be necked down, or stepped down in a variety of ways including: 1) being extruded at the mill so as to have at least two different cross-sectional thicknesses (the thinner being adjacent an elongate edge where a cutting edge would later be ground thereon); 2) being rolled at the mill as it is being extruded or thereafter; 3) being rolled before, after or during the blade shape/form stamping process while the blade stock material (the strip) is still in the soft or annealed condition (before heat treating); 4) being stamped or swaged either with the blade stamping die when the die is cutting the blade shapes/forms, or with a separate die or equivalent, before or after the blade shapes are stamped into the strip; and 5) being rough ground before the normal edge sharpening grinding operations of the strip grinding process, including, as an additional procedure performed by the strip grinder, or otherwise.

For at least some of the manufacturing processes as according to this invention that neck down blade stock material, such as sections of strip, or laser cut precursor blade articles etc for example (but not limited to), it is apparent that the blade stock material may be sandwiched between a fixture or otherwise associated with a rigid shape-maintaining device (or equivalent) when having and edge section or edge sections thereof necked down as according to this invention, such that the blade stock material maintains a cross-sectional thickness substantially not wider than the widest cross-sectional thickness the blade stock material had immediately before the necking down process. Such means for manufacturing prevents any bulging-out or flaring-out of the blade stock material at the junction of the newly formed steps with the side face sections thereof. As according to yet other preferred embodiments of this invention, any bulge-out from the necking down process, could be eliminated in yet different operations and manners, which could be in conjunction with the necking down process or done separately thereafter.

For blades that are not at least in part fabricated from strip grinding, or cutting edge(s) of blades that are not strip ground, the necked down stepped edge section(s), or equivalent, could be created in a variety of ways including those described above, as well as by other ways. For example, cutting blades having serrated or other irregular, non-linear, cutting edge contours could have the necked down stepped area formed by swaging or stamping a step in the shape the irregular cutting edge contour is to be ground or sharpened thereon, or at least substantially similar thereas so as to attain desired functional objective results as according to this invention.

Figure 42:
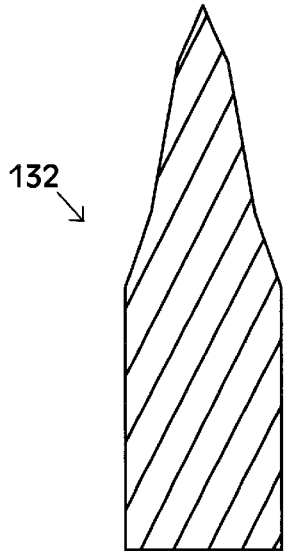
FIG. 42 is an enlarged cross-sectional view of a blade cutting edge of the arrowhead of FIG. 41 as taken along 42—42.
Figure 43:
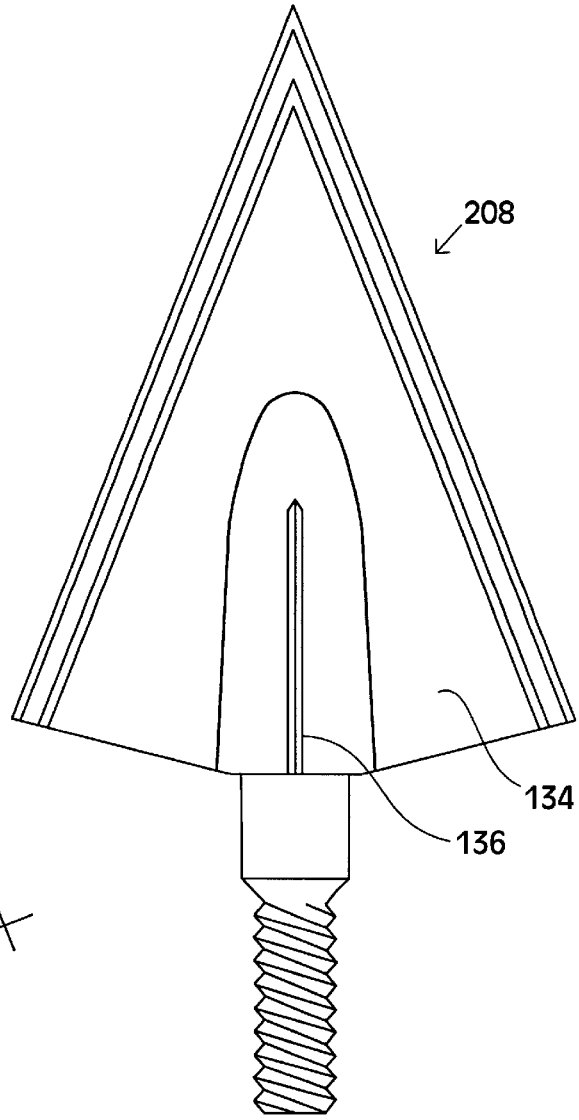
FIG. 43 is a side view of a fixed-blade cut-on-contact arrowhead as according to this invention.
Figure 41:
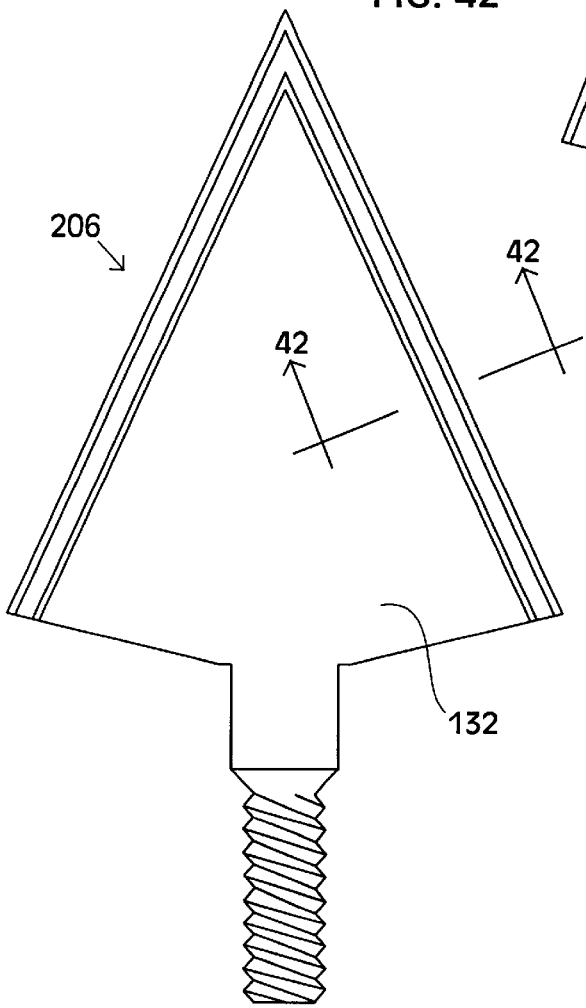
FIG. 41 is a side view of a traditional flathead arrowhead as according to this invention.

FIGS. 41–43 illustrate fixed-blade arrowheads 206 & 208. Arrowhead 206 is a flathead broadhead or arrowhead having a non-replaceable cutting blade 132 integrally attached or formed with/to the arrowhead, whereas arrowhead 208 has a main cutting blade 134 and a pair of bleeder blades 136 (only one bleeder blade 136 is illustrated in FIG. 43) removably attached therewith. Flathead arrowhead 206 may be formed from cast metal such as tool steel, or may be fabricated from welded sections of sheet metal material as is known in the art, or may be made of different types of components welded, glued, or attached together so as to form at least a part of the arrowhead. It is apparent that flathead arrowhead 206 may have the forward leading end of blade 132 flattened or blunted so as to define a chisel type configuration as is known in the art, and that such chisel configuration can have the structural features for obtaining a sharper cutting edge as set forth herein.

It is apparent that the cutting blades and blade stock material, such as strip and laser cutting sheets for example, of the embodiments as according to this invention can be made of various different materials so as to be enabled to achieve the desired results as envisioned by the scope of this invention. Such materials may include, but not limited to: various different steels, including tool steels; M-2, S-7 & D-2, stainless steels; such as 301, 304, 410, 416, 420, 440A, 440B, 440C, 17-4 PH, 17-7 PH, 13C26, 19C27, G1N4, & other razor blade stainless steels, high speed steel, carbon steels, carbides, titanium alloys, tungsten alloys, tungsten carbides, as well as other metals, ceramics, zirconia ceramics, organic polymers, organic polymer containing materials, plastics, glass, silicone containing compounds, composites, or any other suitable material that a cutting blade or equivalent could be fabricated from, or could be at least in part fabricated from.

FIGS. 44–47 illustrate a section of a strip 600 (blade stock material from which blades will be formed in the process of strip grinding), and a section of strip 602. Strip 600 has a pair of opposing parallel flat exterior side faces 160. Strip 602 has a pair of opposing parallel flat exterior side faces 162.

Figure 47:
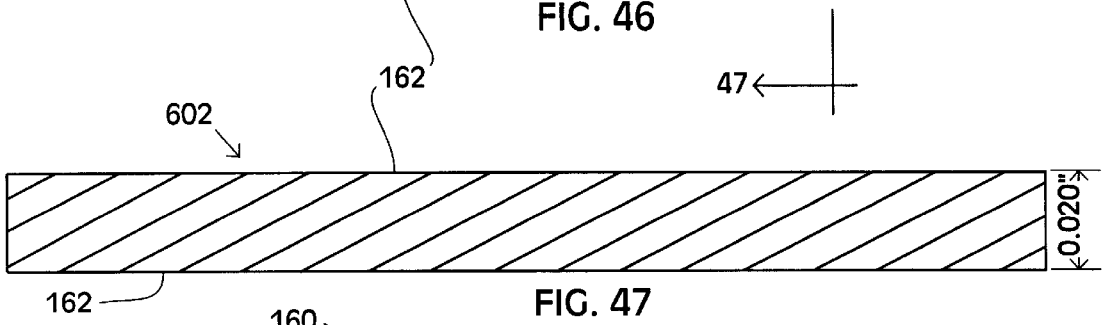
FIG. 47 is an enlarged cross-sectional view of the strip of FIG. 46 as taken along 47—47.
Figure 45:
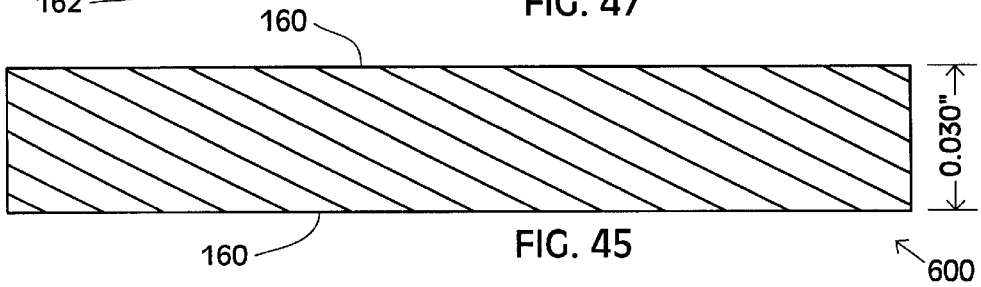
FIG. 45 is an enlarged cross-sectional view of the strip of FIG. 44 as taken along 45—45.
Figure 48:
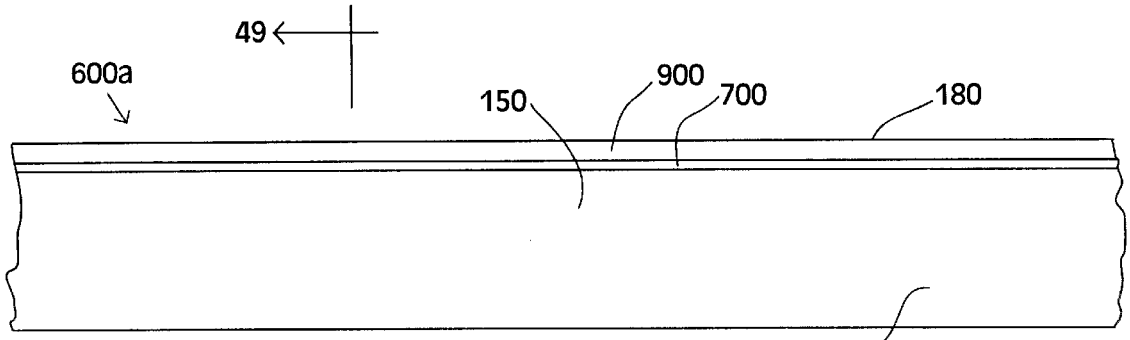
FIG. 48 is a side view of the section of blade stock material strip as of FIG. 44 with an edge section thereof necked down as according to at least some of the embodiments of this invention.
Figure 50:
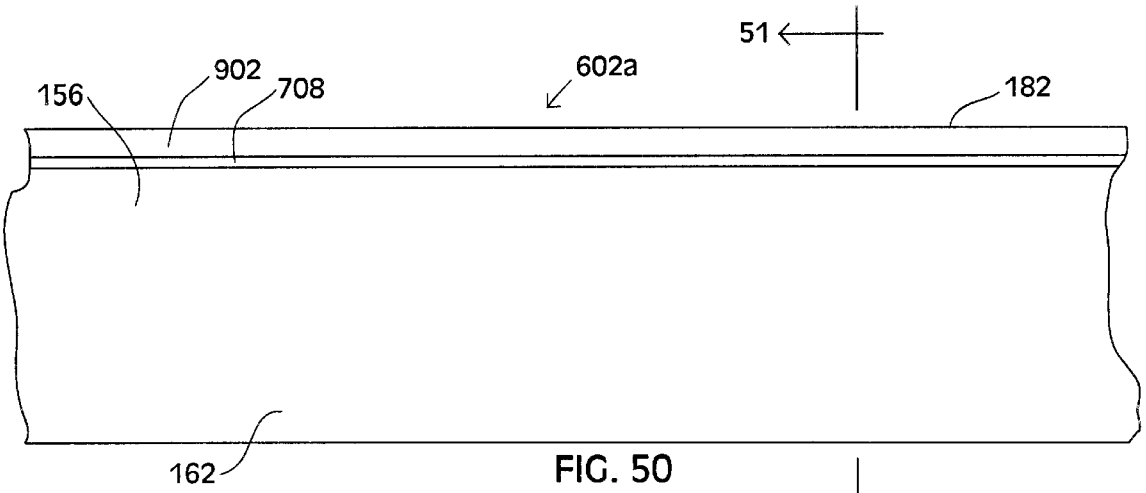
FIG. 50 is a side view of the section of blade stock material strip as of FIG. 46 with an edge section thereof necked down as according to at least some of the embodiments of this invention.

Side faces 160 & 162 become side faces of cutting blades as according to the this invention as set forth in this specification. As is illustrated in FIGS. 45 & 47 both strip 600 and strip 602 have uniform cross-sectional thicknesses for their entire length. Strips 600 & 602 could be made from 440C stainless steel or other materials as set forth herein.

The term blade shape or blade form generally refers to a precursor article or entity that is substantially shaped as a cutting blade before cutting edge sharpening thereon, and that becomes a cutting blade or equivalent as according to at least some of the embodiments of this invention. For example, the structures "break-offably" attached to strip grinding strip after the blade stamping process that become cutting blades, are blade shapes or blade forms as according to this invention. The term blade shapes or blade forms also generally refers to precursor articles or entities that are substantially shaped as a cutting blade before cutting edge sharpening thereon that are cut by a laser, a water-jet or otherwise, from a sheet or blank of blade stock material or etc.

As has been previously noted hereabove, it is apparent that strip grinding strips sections numbered 600, 602 as well as subalphabetical numbered variations thereof (i.e. 600*a*, 600*b*, etc & 602*a*, 602*b*, etc), and blade stock material sections as according to this invention such as blade stock material 680 (but not limited to) as in FIGS. 8, 17, 20, 23 & 26 for example, and other blade stock material sections numbered subalphabetically thereof (i.e. 680*a*, 680*b*, 680*c* etc) as according to some of the preferred embodiment variations hereof, could be referring to (but not limited to) the same sections of blade stock material, despite having different reference numerals. For example, a blade stock material section 680 as of FIG. 8 could be a section of strip 600 as of FIG. 44, or blade stock material section 680 as of FIG. 8 could specifically not be a section of strip 600, depending on the specific embodiment and/or manufactural procedural situation of this invention.

FIGS. 48–51 illustrate a section of a strip 600*a* and a section of a strip 602*a*. Strips 600*a* & 602*a* are strips 600 & 602 (previously depicted in FIGS. 44–47) which have been necked down as according to this invention. Strip 600*a* has a pair of necked down side faces 900 and a pair of steps 700, whereas strip 602*a* has a pair of necked down side faces 902 and a pair of steps 708. Strip 600*a* has a top edge 180 and strip 602*a* has a top edge 182. Top edges 180 & 182 could have a bulged or rounded shape instead of the flat shape as depicted in corresponding FIGS. 49 & 51. Such bulged shape could be caused from the necking down process, depending on if strips 600*a* & 602*a* were shaped by rolling between at least two rollers, otherwise rolled, stamped or otherwise formed. Top edges 180 & 182 are the locations upon strips (blade stock material) 600*a* & 602*a* where cutting edges will be formed thereon as according to at least some of the embodiments of this invention. It is apparent that strips 600*a* & 602*a*, and other strips as according to this invention could have both elongate edge sections thereof necked down, so as to become sharper cutting edges as according to this invention.

It is apparent that the blade shapes or blade forms (precursor blade articles) as according to this invention may have a plurality of different spaced apart and different oriented necked down edge sections as according to this invention, which may communicate with each other, or which may not communicate with each other.

It is also apparent that necked down sections to later become sharpened cutting edges could be formed along portions of strip, or equivalent, in directions inclined relative to the elongate edge sections (or equivalent) thereof such as edge 180 of strip 600*a* for example, so as to at least in some instances (but not limited to) traverse diagonally or even perpendicularly between corresponding elongate edge sections thereof.

As illustrated in FIGS. 48, 49, 52, 53, 56, 57, 60 & 61, sections 150 of side faces 160 of strip 600*a* become side faces 150 of blades 106 as will be illustrated in at least some of the method(s) for obtaining improved sharper cutting blades as according to this invention. Likewise, as illustrated in FIGS. 50, 51, 54, 55, 58, 59, 63 & 64, sections 156 of side faces 162 of strip 602*a* become side faces 156 of yet another cutting blade 199 as will be taught herein.

Figure 51:
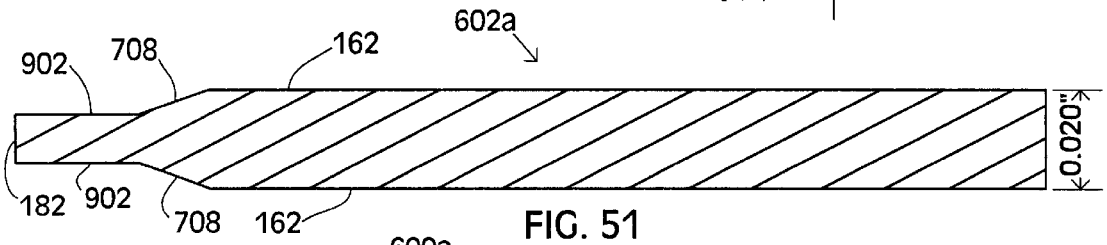
FIG. 51 is an enlarged cross-sectional view of the necked down strip of FIG. 50 as taken along 51—51 of FIG. 50.
Figure 49:
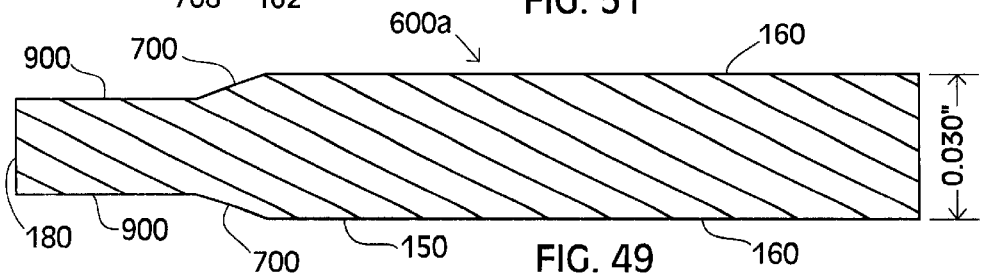
FIG. 49 is an enlarged cross-sectional view of the necked down strip of FIG. 48 as taken along 49—49 of FIG. 48.
Figure 52:
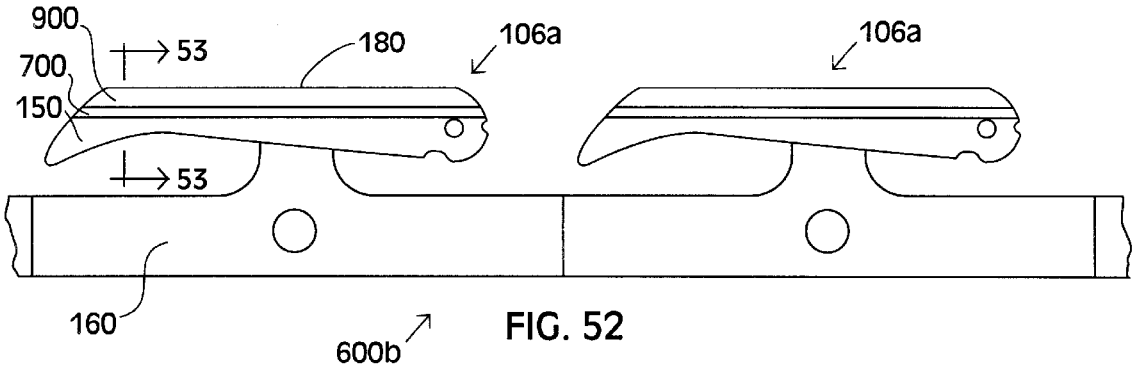
FIG. 52 is a side view of either: 1) the section of necked down blade stock material strip as of FIG. 48 after die stamping, wherein the blade forms or blade shapes were cut out via stamping after the strip was necked down as according to at least some of the embodiments of this invention, or 2) a section of necked down, die stamped, blade stock material strip as of FIG. 56, wherein the blade forms/shapes or strip was necked down during or after the blade stamping process as according to at least some of the embodiments of this invention.
Figure 54:
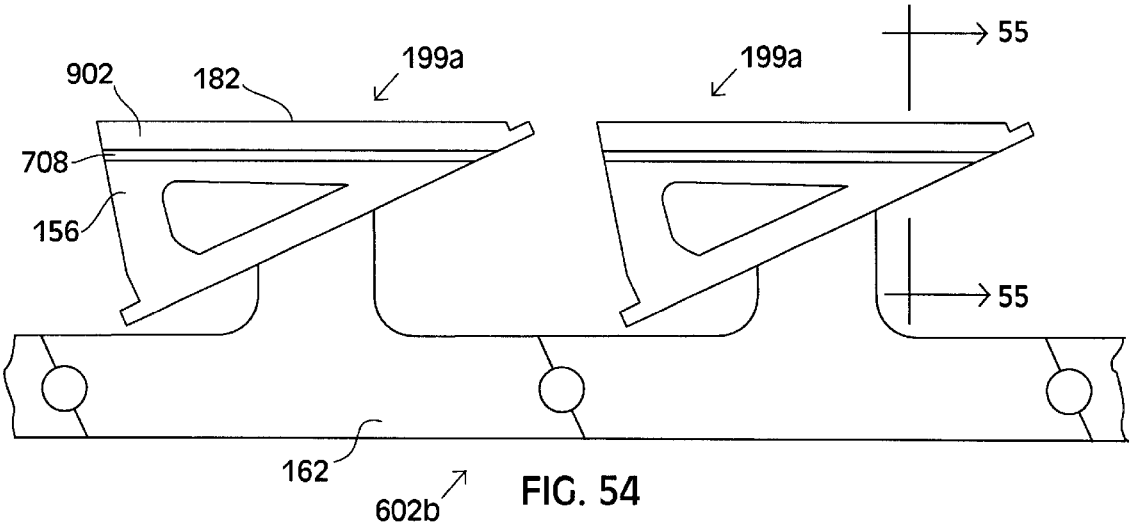
FIG. 54 is a side view of either: 1) the section of necked down blade stock material strip as of FIG. 50 after die stamping, wherein the blade forms or blade shapes were cut out via stamping after the strip was necked down as according to at least some of the embodiments of this invention, or 2) a section of necked down, die stamped, blade stock material strip as of FIG. 58, wherein the blade forms/shapes or strip was necked down during or after the blade stamping process as according to at least some of the embodiments of this invention.
Figure 55:
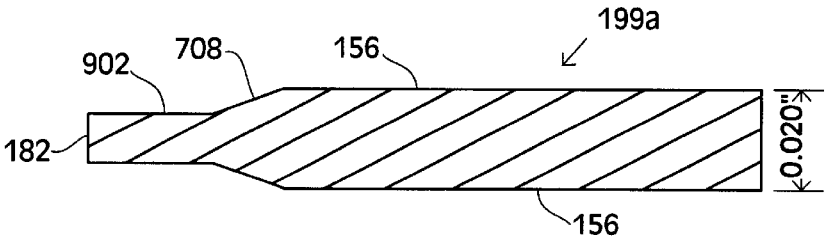
FIG. 55 is an enlarged cross-sectional view of the necked down blade shape or blade form of the strip as of FIG. 54 as taken along 55—55.

As clearly illustrated in FIGS. 49 & 51 strip 600*a* does not have a uniform cross-sectional thickness for its entire length, and strip 602*a* does not have a uniform cross-sectional thickness for its entire length, so as to aid in achieving the desired increased sharpness cutting edge results as according to the fabricating methods and desired structural results of the cutting blades taught herein, while retaining or optimizing structural blade strength as according to this invention. Such non-uniform cross-sectional thickness creates inside corners as has been taught herein—see FIG. 19 for example. Strip 600*a* has a maximum cross-sectional thickness of 0.030" and strip 602*a* has a maximum cross-sectional thickness of 0.020".

It is apparent that the thicknesses of the cutting blades as according to this invention, and that the thickest cross-sectional thickness of a section of necked down blade stock material as according to this invention, may be as thin as 0.003" or 0.004" or thinner, and provide cutting blades enabled to achieve the desired results as according to this invention.

It is apparent that the blades or blade shapes/forms as according to this invention may be fabricated at least in part by acid etching, or other types of etching, even so much as to at times aid in formation of a sharp cutting edge thereof, but not limited thereto.

It is apparent that different cross-sectional thicknesses, as in reference to blade stock material as according to this invention, generally refers to active design intentions or manufacturing intentions so as to make at least a section of blade stock material to have different cross-sectional thicknesses, and does not include variations in thickness or thicknesses due to manufacturing tolerances nor surface irregularities where the intent was to manufacture blade stock material of a uniform thickness.

FIGS. 52–55 illustrate a strip 600*b*, and a strip 602*b*, which are strips 600*a* & 602*a* (FIGS. 48 & 50) respectively, after having blade shapes 106*a* & 199*a* stamped respectively thereon.

FIGS. 56–59 illustrate a strip 600*c*, and a strip 602*c*, which are strips 600 & 602 (FIGS. 44 & 46) respectively after having blade shapes 106*b* & 199*b* stamped respectively thereon. It is apparent that strips 600*c* & 602*c* could be necked down to be substantially as strips 600*b* & 602*b* as in FIGS. 52 & 54, after or during when blade shapes 106*b* & 199*b* were/are stamped or cut into precursor strips 600 & 602 as per FIGS. 44 & 46.

As is evident from FIGS. 44–47, FIGS. 48–51, FIGS. 52–55 & FIGS. 56–59 and from the discussion of the invention as set forth herein, it is apparent that the necked down blade face sections such as necked down blade faces 900 of blade shape 106*a* (FIG. 53) as well as the steps such as steps 700 of blade shape 106*a* (FIG. 53) can be formed upon corresponding strips or blade stock material in various manners and at various sequential times throughout the blade manufacturing process.

FIGS. 60 & 63 illustrate strips 600*d* & 602*d* having finished sharpened blades 106 and 199 "break-offably" attached respectively thereon as according to this invention. As a generally final stage in the strip grinding process for manufacturing cutting blades, the sharpened blades are broken-off the strip at the score lines thereof, thus the term: "break-offably" attached.

FIG. 60 illustrates pivotal blades 106, as previously discussed as per FIGS. 16 & 19, attached to strip 600*d* wherein each blade 106 has a pair of primary grind bevels 300, a pair of hone bevels 400, a cutting edge 500, a pair of opposing side faces 150, and a pair of inclined steps 700.

FIG. 61 illustrates a cross-section of a blade 106, wherein angle 804 depicts the angle between opposing hone bevels 400, and angle 806 depicts the angle between opposing primary grind bevels 300 of blade 106.

FIG. 62 illustrates an outline of the exterior surface of primary grind bevels 300 and hone bevels 400 of blade 106 as illustrated in perpendicular cross-section of blade 106 as per FIG. 61.

FIG. 63 illustrates fixed-blades 199 "break-offably" attached to strip 602*d*, wherein each blade 199 has a pair of primary grind bevels 308, a pair of hone bevels 406, a cutting edge 510, a pair of opposing side faces 156, and a pair of inclined steps 710.

FIG. 64 illustrates a cross-section of blade 199, wherein an angle 808 depicts the angle between opposing hone bevels 406, and an angle 810 depicts the angle between opposing primary grind bevels 308 of blade 199.

FIG. 65 illustrates an outline of the exterior surface of primary grind bevels 308 and hone bevels 406 of blade 199 as illustrated in perpendicular cross-section of blade 199 as per FIG. 64.

As illustrated in FIG. 62, angle 804 depicts the angle between opposing hone bevels 400 and angle 806 depicts the angle between opposing primary grind bevels 300 of blade 106. Blade 106 has a maximum cross-sectional thickness of 0.030" (inches).

As illustrated in FIG. 65, angle 808 depicts the angle between opposing hone bevels 406 and angle 810 depicts the angle between opposing primary grind bevels 308 of blade 199. Blade 199 has a maximum cross-sectional thickness of 0.020" (inches).

Therefore, as is evident from FIG. 66 wherein the outlines of the bevel exterior surfaces of FIGS. 62 & 65 are superimposed upon each other, cutting edge 510 of blade 199 is sharper (narrower angles between corresponding bevels) than cutting edge 500 of blade 106.

Cutting edge 510 of blade 199 is also sharper than cutting edge 500 of blade 100 as illustrated in FIG. 13, which has a maximum cross-sectional thickness that is the same as blade 100; that of 0.020".

Figure 53:
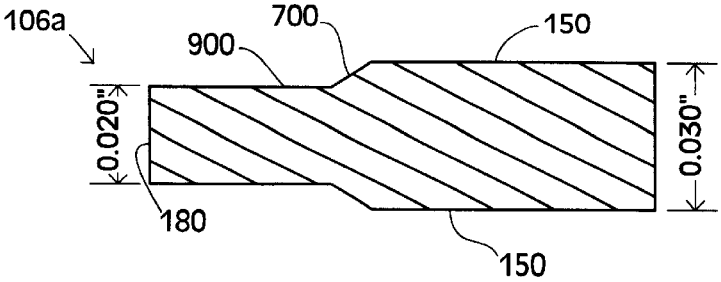
FIG. 53 is an enlarged cross-sectional view of the necked down blade shape or blade form of the strip as of FIG. 52 as taken along 53—53.
Figure 56:
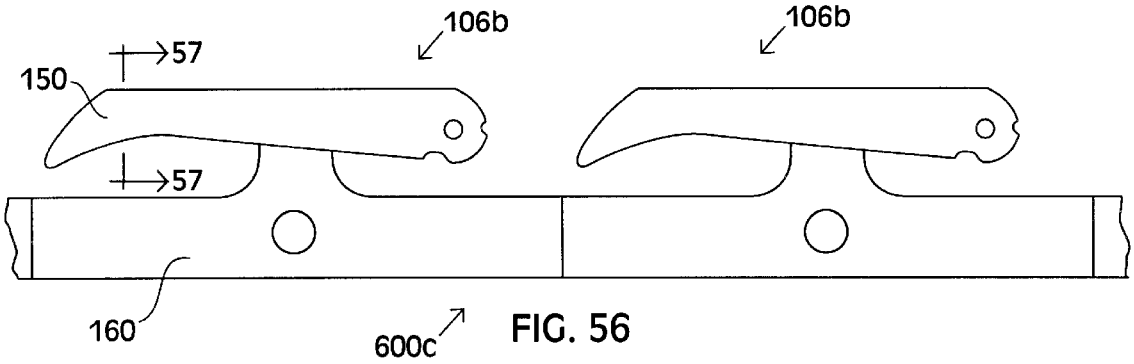
FIG. 56 is a side view of the section of blade stock material strip as of FIG. 44 after die stamping with the blade forms or blade shapes cut out and remaining attached to the strip as according to this invention.
Figure 58:
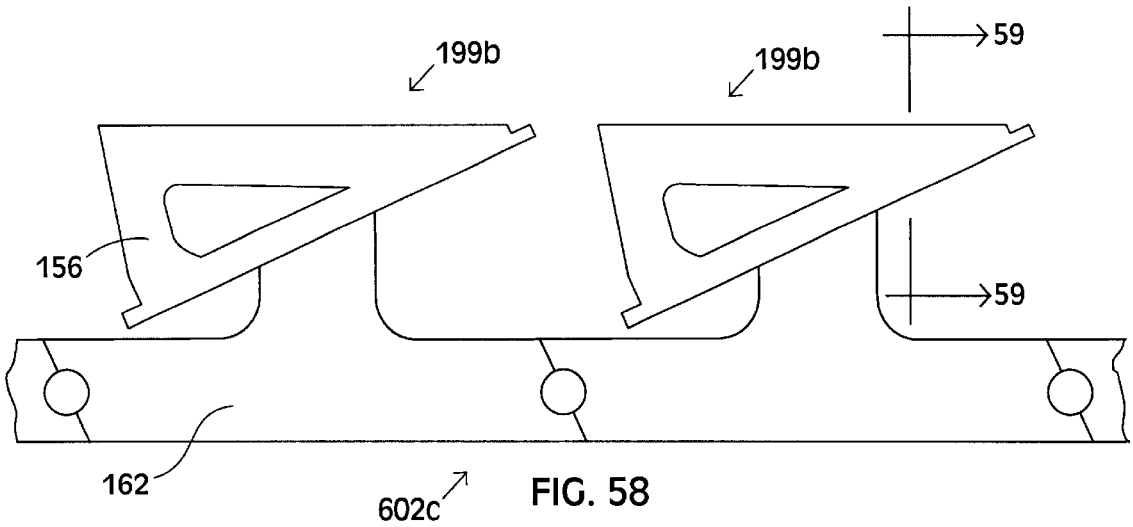
FIG. 58 is a side view of the section of blade stock material strip as of FIG. 46 after die stamping with the blade forms or blade shapes cut out and remaining attached to the strip as according to this invention.
Figure 59:
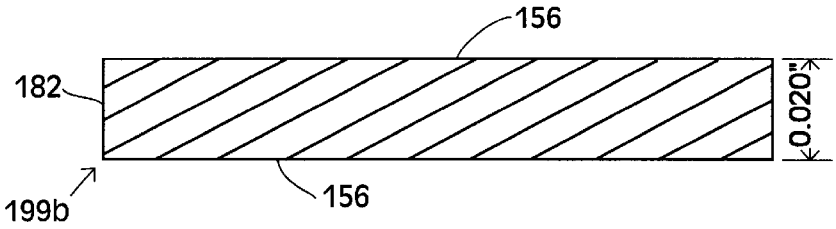
FIG. 59 is an enlarged cross-sectional view of the blade shape or blade form of the strip as of FIG. 58 as taken along 59—59.
Figure 57:
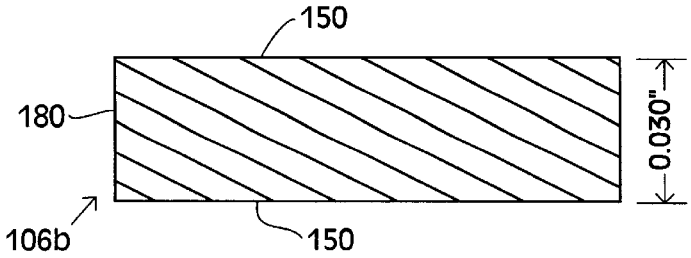
FIG. 57 is an enlarged cross-sectional view of the blade shape or blade form of the strip as of FIG. 56 as taken along 57—57.

It is apparent that the necked down side face sections as according to this invention, such as necked down side faces 900 of blade shape 106*a* as in FIG. 53, can have various different shapes and planar orientations, other than illustrated herein, such as sloped or inclined relative to blade side faces 150, or relative to other blade faces of corresponding blades or blade shapes of yet other preferred embodiments of this invention.

Figure 67:
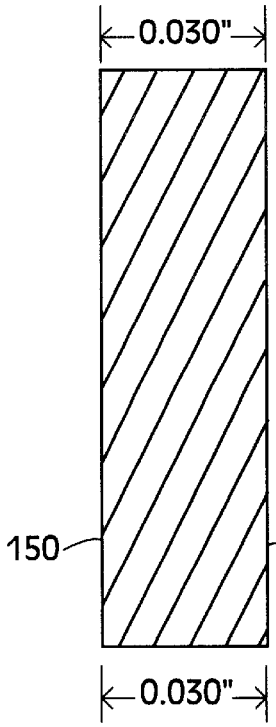
Figure 68:
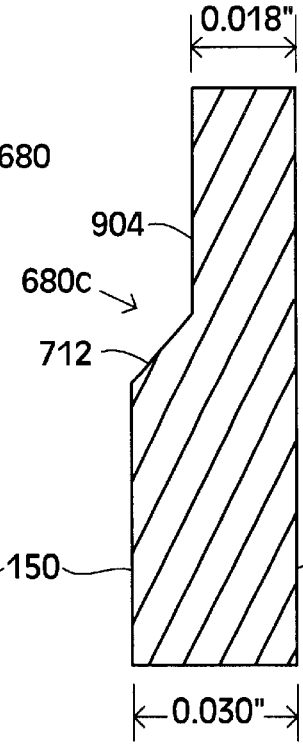
FIG. 68 is a cross-sectional view of the blade stock material of FIG. 67 that has been necked down.
Figure 69:
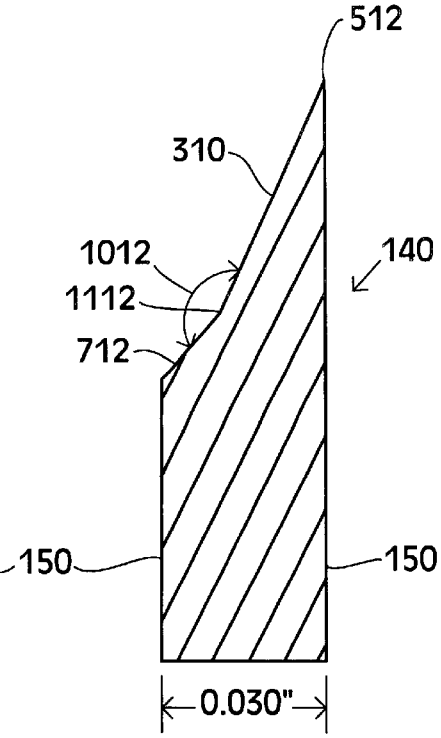
FIG. 69 is a cross-sectional view of a cutting blade as according to this invention fabricated from the necked down blade stock material as of FIG. 68.

FIG. 67 illustrates blade stock material 680 as previously discussed herein. FIG. 68 illustrates necked down blade stock material 680*c* having a step 712, a necked down side face 904, and a pair of side faces 150. FIG. 69 illustrates a cutting blade 140 as according to this invention which is necked down blade stock material 680*c* having a grind bevel 310 formed thereon so as to define a cutting edge 512 thereof. An inside corner 1112 is defined between bevel 310 and step 712, so as to have an angular offset 1012 therebetween of less than 180 degrees, as is according to the inside corners of the cutting edges and cutting blades or equivalents of this invention.

Figure 70:
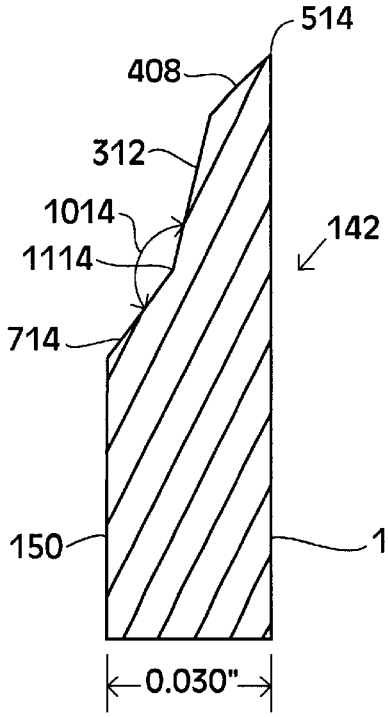
FIG. 70 is a cross-sectional view of a cutting blade as according to this invention fabricated from the necked down blade stock material as of FIG. 68.

FIG. 70 illustrates a cutting blade 142 as according to this invention, which is necked down blade stock material 680*c* having a cutting edge 514, a primary grind bevel 312, a hone bevel 408, and a step 714 formed thereon. An inside corner 1114 is defined between bevel 312 and step 714, so as to have an angular offset 1014 therebetween of less than 180 degrees, as is also according to the inside corners of the cutting edges and cutting blades of this invention.

As has been depicted with the cutting edges of the cutting blades of this invention thus far, wherein the cutting edges have been either: 1) in coplanar alignment with a side face, such as is right side face 150 of cutting blade 142 coplanar with cutting edge 514 as viewed in FIG. 70; or 2) substantially equidistantly centered between opposing side faces, such as are cutting edges 500 & 510 of cutting blades 106 & 199 substantially equidistantly centered between opposing side faces 150 thereof as in FIGS. 61 & 64, it is apparent that the cutting edges of the cutting blades of at least some of the preferred embodiments of this invention may be spaced apart non-equidistantly from opposing blade side faces.

Figure 71:
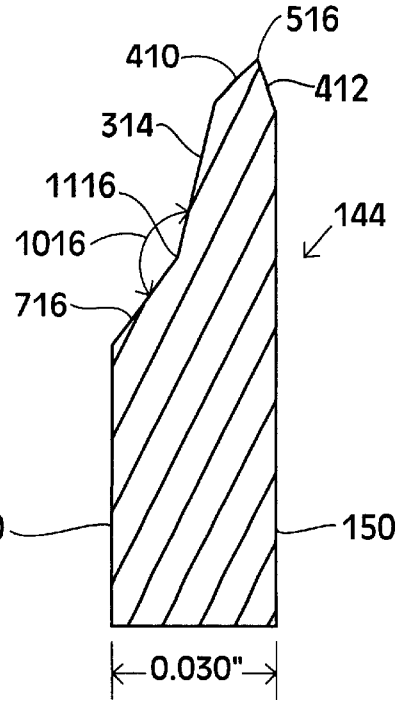
FIG. 71 is a cross-sectional view of a cutting blade as according to this invention fabricated from the necked down blade stock material as of FIG. 68.

FIG. 71 illustrates a cutting blade 144 as according to this invention, which is necked down blade stock material 680*c* as per FIG. 68, having a cutting edge 516, a primary grind bevel 314, a first hone bevel 410 having a first different inclined orientation, a second hone bevel 412 having a second different inclined orientation, and a step 716 formed thereon. An inside corner 1116 is defined between bevel 314 and step 716, so as to have an angular offset 1016 therebetween of less than 180 degrees. Cutting edge 516 is offset from side faces 150 so as to be non-equidistantly centered between opposing side faces 150 thereof, as is according to at least some of the embodiments of this invention.

It is apparent that at least some of the cutting blades as according to this invention can have at least one blade side face with different spaced apart sections thereof disposed in planes not parallel to one another. Such for example, as a bent flange portion to aid in securing a fixed-blade arrowhead blade to an arrowhead body, as is known in the art.

The cutting blades as according to the desired results and scope of this invention have sharper cutting edges than prior art cutting blades.

The cutting blades as according to the desired results and scope of this invention have sharper cutting edges and are more rigid and structurally strong than prior art cutting blades with similar sharpnesses of cutting edges, or similar angles between opposing bevels.

The cutting blades as according to the desired results and scope of this invention enable thicker cutting blades to be produced more economically.

The cutting blades as according to the desired results and scope of this invention enable thicker cutting blades having acuter cutting edges to be produced more economically.

The arrowhead cutting blades as according to the desired results and scope of this invention are more lethal than prior art conventional arrowhead cutting blades in that they provide a sharper cutting edge, so as to better cut the game animals and therefore maximize penetration and lethality.

As has been shown in the above discussion, the cutting blades of the arrowheads and the cutting blades (or equivalents) of the other cutting devices (or equivalents) according to this invention overcome deficiencies inherent in prior art cutting blades (or equivalents).

The cutting edges of the cutting blades as according to this invention may be stropped or may not be stropped. The cutting blades as according to this invention and/or their cutting edges may be coated or at least partially coated with various different types of materials such as friction reducing elements (Polytetrafluoroethylene—PTFE) and other fluoropolymers for example, corrosion resistant coatings and wear resistant coatings including: titanium nitride, titanium carbide, chrome nitride, LSR-1, ceramic coatings, and other coatings such as suggested in U.S. Pat. No. 5,630,275, or yet other coatings or equivalents, or combinations thereof.

It is apparent that arrowheads as according to this invention could be shot from an archery bow or equivalent with the expandable blades in an open position such as is depicted in FIG. 5 so as to be substantially a non-blade opening pivotally bladed arrowhead as is known to those skilled in the art. It is apparent that the desired results and scope of this invention are applicable to the various other types of non blade-opening, pivotally bladed or expanding arrowheads as known to those skilled in the art, as well as to other arrowheads which are not of necessity disclosed herein.

Although the preferred arrowhead embodiments of this invention have been depicted as having a plurality of two, three or four blades each, it is apparent that the arrowheads according to this invention may have any number of blades. Although the preferred embodiments of this invention have been depicted as having blades and accompanying blade slots substantially in radial alignment with the central longitudinal axis of corresponding arrowhead bodies it is apparent that the arrowheads as according to this invention may have non-radially aligned cutting blades and corresponding blade slots which also may be non-radially aligned therewith.

It is apparent that the different parts and elements and their equivalents of the cutting blades or equivalents and the arrowheads of this invention, as discussed above and according to other preferred embodiments of this invention, can be changed, or interchanged, or eliminated, or duplicated, or made of different materials, and connected to or associated with adjacent elements in different manners, other than suggested herein, without deterring from the desired results of this invention.

It is to be understood that the present invention is not limited to the sole embodiments described above, as will be apparent to those skilled in the art, but encompasses the essence of all embodiments, and their legal equivalents, within the scope of the following claims.

I claim:

1. An arrowhead cutting blade comprising:

(a) a side face;

(b) a cutting edge; and (c) an inside corner disposed between the side face and the cutting edge wherein a plurality of different inclined sections transition between the side face and the cutting edge, the inside corner being disposed between two of the different inclined sections.

2. An arrowhead cutting blade as recited in claim 1, wherein a first inclined section comprises a primary grind bevel, and a second different inclined section comprises a step.

3. An arrowhead cutting blade as recited in claim 2, wherein the inside corner is not arcuate.

4. An arrowhead cutting blade as recited in claim 2, wherein the cutting blade further includes a third different inclined section comprising a hone bevel.

5. An arrowhead cutting blade as recited in claim 4, wherein the hone bevel and/or the primary grind bevel is either substantially convex, or concave or flat.

6. An arrowhead cutting blade comprising:

(a) a cutting edge; and (b) a first side face and a second side face, the first side face being configured on a first side of the cutting edge, and the second side face being configured on a second side of the cutting edge, wherein a plurality of different inclined sections transition between each side face and the cutting edge, and an inside corner is disposed between two of the different inclined sections on both sides of the cutting edge.

7. An arrowhead cutting blade as recited in 6, wherein the cutting edge is substantially equidistantly spaced apart from each of the side faces.

8. An arrowhead cutting blade as recited in claim 6, wherein on each side of the cutting edge, a plurality of different inclined sections are either swaged, and/or rolled, and/or stamped on the cutting blade.

9. An arrowhead cutting blade comprising:

(a) a side face;

(b) a cutting edge; and (c) an inside corner disposed between the side face and the cutting edge wherein the cutting edge defines a plurality of linear segments that are not collinear with each other.

10. An arrowhead cutting blade comprising:

(a) a pair of opposing side faces;

(b) a cutting edge;

(c) a plurality of opposing primary grind bevels and a plurality of opposing steps, wherein at least one primary grind bevel and at least one step transitions between each side face and the cutting edge, the steps adjoining corresponding side faces; and (d) a plurality of inside corners, the cutting blade being configured such that an inside corner is disposed between each primary grind bevel and each step.

11. An arrowhead cutting blade as recited in claim 10, wherein the primary grind bevels extend to the cutting edge.

12. An arrowhead cutting blade as recited in claim 11, wherein the cutting edge defines a plurality of linear segments that are not collinear with each other.

13. An arrowhead cutting blade as recited in claim 10, wherein the number of primary grind bevels is more than two.

14. An arrowhead cutting blade as recited in claim 10, wherein the cutting blade has a wing that outwardly projects from a main body portion thereof.

15. An arrowhead cutting blade as recited in claim 10, wherein at least a section of the cutting edge is fabricated from a strip grinding process.

16. An arrowhead cutting blade as recited in claim 10, wherein the cutting blade further comprises a plurality of opposing hone bevels disposed adjacent the cutting edge.

17. An arrowhead cutting blade as recited in claim 16, wherein the cutting edge is stropped.

18. An arrowhead cutting blade as recited in claim 16, wherein the number of primary grind bevels is two.

19. An arrowhead cutting blade as recited in claim 10, wherein the cutting edge is entirely monolinear.

20. An arrowhead cutting blade as recited in claim 10, wherein the cutting blade has at least one aperture extending therethrough.

21. An arrowhead cutting blade as recited in claim 20, wherein the cutting blade is hingedly attached to an arrowhead body.

22. An arrowhead cutting blade as recited in claim 20, wherein the cutting blade is fixedly attached to an arrowhead body.

23. An arrowhead cutting blade as recited in claim 10, wherein the cutting blade is part of a blade-opening arrowhead.

24. An arrowhead cutting blade comprising:

(a) a cutting edge;

(b) a first side face disposed on a first side of the cutting edge and a second side face disposed on a second side of the cutting edge, the first side face being configured on a first side of the cutting blade, and the second side face being configured on a second side of the cutting blade;

(c) a first angle defined between:

(i) a first inclined section which adjoins the first side face; and (ii) the exterior surface of the second side of the cutting blade directly opposite the first inclined section; and (d) a second angle defined between:

(i) a second inclined section on the first side of the cutting blade disposed just closer toward the cutting edge from the first inclined section; and (ii) the exterior surface of the second side of the cutting blade directly opposite the second inclined section, wherein the first angle is larger than the second angle.

25. An arrowhead cutting blade as recited in claim 24, the cutting edge is a double bevel cutting edge.

26. An arrowhead cutting blade as recited in calm 25, wherein a primary grind bevel and a hone bevel are disposed on both sides of the cutting edge.

27. An arrowhead cutting blade as recited in claim 24, wherein only one side of the cutting blade has a bevel or bevels thereon.

28. An arrowhead cutting blade comprising:

(a) a side face;

(b) a cutting edge; and (c) a plurality of at least three different sloped sections transitioning between the side face and the cutting edge.

29. An arrowhead cutting blade as recited in claim 28, wherein a first different sloped section comprises a hone bevel adjoining the cutting edge, a second different sloped section comprises a primary grind bevel adjoining the hone bevel, and a third different sloped section comprises a step disposed between the primary grind bevel and the side face.

30. An arrowhead cutting blade as recited in claim 29, wherein the cutting blade has a pair of opposing side faces disposed on either side of the cutting edge.

31. An arrowhead cutting blade as recited in claim 30, further comprising an inside corner disposed between the cutting edge and only one of the side faces.

32. An arrowhead cutting blade as recited in claim 30, wherein the cutting blade is configured such that a hone bevel, a primary grind bevel, and a step transition between each side face and the cutting edge.

33. An arrowhead cutting blade as recited in claim 32, wherein the hone bevels and/or the primary grind bevels are either flat or convex or concave.

34. An arrowhead cutting blade as recited in claim 32, wherein the angular offset between the hone bevels is greater than the angular offset between the primary grind bevels.

35. An arrowhead cutting blade as recited in claim 34, the hone bevels and/or the primary grind bevels are either flat or convex or concave.

36. An arrowhead cutting blade as recited in claim 34, wherein the angular offset between the steps is greater than the angular offset between the primary grind bevels.

37. An arrowhead cutting blade as recited in claim 32, the angular offset between the steps is greater than the angular offset between the primary grind bevels.

38. An arrowhead cutting blade as recited in claim 28, wherein the plurality of different sloped sections are all formed by grinding.

39. An arrowhead cutting blade as recited in claim 38, further comprising a second side face wherein a plurality of at least three different sloped sections transition between each side face and the cutting edge.

* * * * *